US008215633B2

(12) United States Patent
Stiehler et al.

(10) Patent No.: US 8,215,633 B2
(45) Date of Patent: Jul. 10, 2012

(54) MEDIA STOPPER METHOD FOR A PRINTING SYSTEM

(75) Inventors: Wayne E. Stiehler, Spencerport, NY (US); Sivanandam T. Sathiyamoorthy, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 45 days.

(21) Appl. No.: 12/871,090

(22) Filed: Aug. 30, 2010

(65) Prior Publication Data

US 2012/0049436 A1 Mar. 1, 2012

(51) Int. Cl.
*B65H 3/52* (2006.01)

(52) U.S. Cl. ..... 271/121; 271/122

(58) Field of Classification Search ..... 271/121, 271/122, 124, 245, 167
See application file for complete search history.

(56) References Cited

U.S. PATENT DOCUMENTS

| | | | | |
|---|---|---|---|---|
| 4,556,209 | A | 12/1985 | Tsubo | |
| 4,674,736 | A | 6/1987 | Tsubo | |
| 5,615,874 | A | 4/1997 | Parthasarathy et al. | |
| 5,711,519 | A | 1/1998 | Bortolotti | |
| 5,857,671 | A | 1/1999 | Kato et al. | |
| 5,895,040 | A | 4/1999 | Oleksa et al. | |
| 5,899,450 | A | 5/1999 | Gettelfinger et al. | |
| 5,971,390 | A | 10/1999 | Caspar et al. | |
| 6,158,733 | A | 12/2000 | Muraki | |
| 6,217,017 | B1 | 4/2001 | Yamazaki | |
| 6,279,897 | B1 | 8/2001 | Richards | |
| 6,392,763 | B1 | 5/2002 | Nishinohara et al. | |
| 6,536,757 | B2 | 3/2003 | Chang | |
| 6,547,235 | B2 | 4/2003 | Higaki | |
| 6,716,254 | B2 | 4/2004 | Takeuchi | |
| 6,893,013 | B2 | 5/2005 | Spitz et al. | |
| 6,896,253 | B2 * | 5/2005 | Hanabusa | 271/117 |
| 7,000,916 | B2 | 2/2006 | Asada et al. | |
| 7,029,004 | B2 | 4/2006 | Asada et al. | |
| 7,036,814 | B2 | 5/2006 | Oh et al. | |
| 7,066,461 | B2 | 6/2006 | Asada | |
| 7,100,914 | B2 | 9/2006 | Ramos | |
| 7,108,257 | B2 | 9/2006 | Shiohara et al. | |
| 7,128,317 | B2 | 10/2006 | Johnson et al. | |
| 7,131,644 | B2 | 11/2006 | Williamson et al. | |
| 7,207,736 | B2 | 4/2007 | Jang | |
| 7,226,048 | B2 * | 6/2007 | Connors et al. | 271/121 |
| 7,331,575 | B2 * | 2/2008 | Kang | 271/121 |
| 7,350,902 | B2 | 4/2008 | Dietl et al. | |
| 7,543,811 | B2 * | 6/2009 | Shimamura | 271/124 |
| 7,665,725 | B2 * | 2/2010 | Bridges et al. | 271/124 |
| 2009/0174748 | A1 | 7/2009 | Balcan | |

* cited by examiner

*Primary Examiner* — Jeremy R Severson
(74) *Attorney, Agent, or Firm* — Eugene I. Shkurko

(57) ABSTRACT

A method of feeding media in an inkjet printer including moving a media stopper element for selectively allowing a sheet of media to advance along a media advance path in a media advance direction. A shaft is connected to the media stopper element for moving the media stopper element by rotating the shaft. The media stopper element can be moved via biasing to a first position for preventing the sheet of media from advancing and to a second position for allowing the sheet of media to advance along the media advance path.

9 Claims, 22 Drawing Sheets

MEDIA STOPPER METHOD FOR A PRINTING SYSTEM

CROSS REFERENCE TO RELATED APPLICATIONS

Reference is made to commonly assigned, co-pending U.S. Patent Applications:

Ser. No. 12/871,067 by Wayne E. Stichler and Sathiyamoorthy T. Sivanandam filed of even date herewith entitled "Pick Roller Retraction In A Carriage Printer";

Ser. No. 12/871,106 by Wayne E. Stiehler and Sathiyamoorthy T. Sivanandam filed of even date herewith entitled "Pick Roller Retraction Method In A Carriage Printer"; and Ser. No. 12/871,078 by Wayne E. Stiehler and Sathiyamoorthy T. Sivanandam filed of even date herewith entitled "Media Stopper For A Printing System";

Ser. No. 12/871,124 by Wayne E. Stiehler filed of even date herewith entitled "Media Separator For A Printing System", the disclosures of which are incorporated herein by reference in their entireties.

FIELD OF THE INVENTION

The present invention generally relates to media feeding in a printer, and more particularly to a media stopper to prevent loaded media from moving too far into the printing mechanism prior to printing.

BACKGROUND OF THE INVENTION

In a printing system a stack of paper or other print media is typically loaded at a media input location, from which the media is moved, one sheet at a time into a printing region for printing, and then is discharged from the printer. In order to pick one sheet at a time from the media input location, generally a paper separator is located between the media input location and the printing region. If the paper is loaded too far into the printing mechanism, such that the lead edge of more than one sheet of paper is past the paper separator, multiple sheets can inadvertently be fed, leading to paper jams and possible damage in the printer. It is well-known to incorporate a media stopper to keep the lead edges of the stack of paper from advancing beyond the paper separator, until it is desired to move a sheet into the printing region for printing, and then retract the media stopper to let the sheet pass. Printing systems include line printing systems, which print a line of pixels substantially at one time (using a page-width printhead for example), and a carriage printer, which prints a swath of pixels. The examples described here will be for a carriage printer, but there can also be applicability for a line printing system.

In a carriage printer, such as an inkjet carriage printer, a printhead is mounted in a carriage that is moved back and forth across the region of printing. To print an image on a sheet of paper or other print medium, the medium is advanced a given nominal distance along a media advance direction and then stopped. While the medium is stopped and supported on a platen, the printhead carriage is moved in a direction that is substantially perpendicular to the media advance direction as marks are controllably made by marking elements on the medium—for example by ejecting drops from an inkjet printhead. After the carriage has printed a swath of the image while traversing the print medium, the medium is advanced, the carriage direction of motion is reversed, and the image is formed swath by swath.

FIG. 1 shows a schematic side view of a prior art carriage printer having a so-called L-shaped paper path. A variety of rollers are used to advance the medium through the printer. In this example, a pick roller 350 moves the first piece or sheet 371 of a stack 370 of paper (also generically called recording medium herein) at media input support 320 from paper load entry direction 301 toward media retention plate 340. Media retention plate 340 is disposed along media advance direction 304 and is at an angle $\alpha$ with respect to media input support 320. Angle $\alpha$ is typically greater than 60 degrees, so that when seen from the side view of FIG. 1, media input support 320 and media retention plate 340 look approximately like a letter L. A media stopper element 342 is indicated in FIG. 1 as a dotted line extending upward at an angle from media retention plate 340. The dotted line position is the normal position of the media stopper element, in order to prevent media from advancing past the media separator (not shown). When paper is being moved out of the media input support for printing (as in FIG. 1), the media stopper element 342 is retracted into the media retention plate 340. After the piece 371 of recording medium moves past the retracted media stopper element 342 and the media separator, which can be referred to as the media advance path, it is then moved by feed roller 312 and idler roller(s) 323 to advance through the print region 303, and from there to a discharge roller 324 and star wheel(s) 325. Carriage 200 moves a printhead die 251 along a carriage scan direction that is into the plane of FIG. 1 and ink drops 270 are controllably ejected to print an image as the carriage is moved. Supporting the piece 371 of recording medium at print region 303 is a platen 390. In order to facilitate the printing of borderless prints where the image is printed to the edges of the recording medium, platen 390 can have support ribs 394 in between which is disposed an absorbent medium 392 to catch ink drops that are oversprayed beyond the edges of the recording medium.

Competitive cost pressures, particularly for printers that are used in the home, drive efforts to reduce components such as motors in a printer. For example, in a carriage printer it is a goal to have one motor that moves the carriage, and another motor that provides power for moving the paper, as well as other motions in the printer. What is needed is a simple, low cost and reliable way of moving the media stopper elements into a retracted position during picking of media from the media input support, and otherwise having the media stopper elements extending from the media retention plate to prevent the lead edges from moving too far into the printing mechanism.

SUMMARY OF THE INVENTION

A preferred embodiment of the present invention includes a method of feeding media in an inkjet printing system by providing a media input support, and providing a media retention plate disposed at an angle with respect to the media input support, wherein the media retention plate includes a slot. A media stopper is provided that includes a rotatable shaft, a stopper element extending from the rotatable shaft and biased to protrude through the slot of the media retention plate, and a lever extending from an end of the rotatable shaft, wherein the lever includes a first contact surface. Also by providing a pick roller configured to rotate in a rotation direction to move a piece of media from the media input support past the media retention plate, providing a gear train for transmitting power to rotate the pick roller, and providing a feed roller configured to receive the piece of media from the pick roller. The feed roller includes a forward direction of rotation to move the piece of media in a same direction as the rotation direction of the pick roller and a reverse direction of rotation that is opposite the forward direction. Also by providing a feed roller gear that is coaxially mounted on the feed roller, and providing a pick clutch assembly that includes a first gear that is engaged with the feed roller gear, a second gear, and an arm including a second contact surface. Also by rotating the feed roller in the reverse direction, thereby causing the pick clutch assembly to pivot the second gear into engagement with the gear train and bringing the second contact surface of the arm of the pick clutch assembly to bear against the first contact surface of the lever of the media stopper. Also by rotating the arm of the pick clutch assembly to push the lever and forcing the biased stopper element to retract through the slot of the media retention plate.

Another preferred embodiment of the present invention includes a method of feeding a sheet of media in an inkjet printer comprising providing a media input support for holding sheets of the media, applying a force upon a shaft for rotating the shaft, the shaft connected to a media stopper element, to move the media stopper element away from a media advance path while the sheet of the media is moved along a media advance direction. By ceasing applying the force upon the shaft including allowing the shaft to return to a biased position, the media stopper element is moved into the media advance path for preventing a next sheet of the media from moving along the media advance direction. The media support is typically inclined at an angle of about 60° or more with respect to a horizontal plane. The step of applying the force upon the shaft includes providing a shaft having a lever connected thereto, and so the step of applying the force includes applying the force upon the lever for rotating the shaft. Allowing the shaft to return to a biased position can include the use of a spring attached to the shaft for biasing the shaft at the biased position. A lever connected to the shaft can be used for attaching the spring to the shaft by also providing a spring attachment feature on the lever.

Another preferred embodiment of the present invention includes a method of moving a media stopper element for selectively allowing a sheet of media to advance along a media advance path in a media advance direction by providing a shaft connected to the media stopper element for moving the media stopper element by rotating the shaft, applying a first rotational force on the shaft to rotationally bias the shaft such that the media stopper element is moved to a first position for preventing the sheet of media from advancing along the media advance path, and applying a second rotational force on the shaft in a direction opposite the first rotational force such that the first rotational force is overcome and such that the media stopper element is moved to a second position for allowing the sheet of media to advance along the media advance path. Applying the first rotational force can include providing a lever connected to the shaft and connecting one end of a spring to the lever to rotationally bias the shaft. The second rotational force on the shaft can include pushing the lever in the opposite direction. This can be accomplished by providing a gear driven arm pressing on the lever, wherein the gear is eventually driven by a motor.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 2:
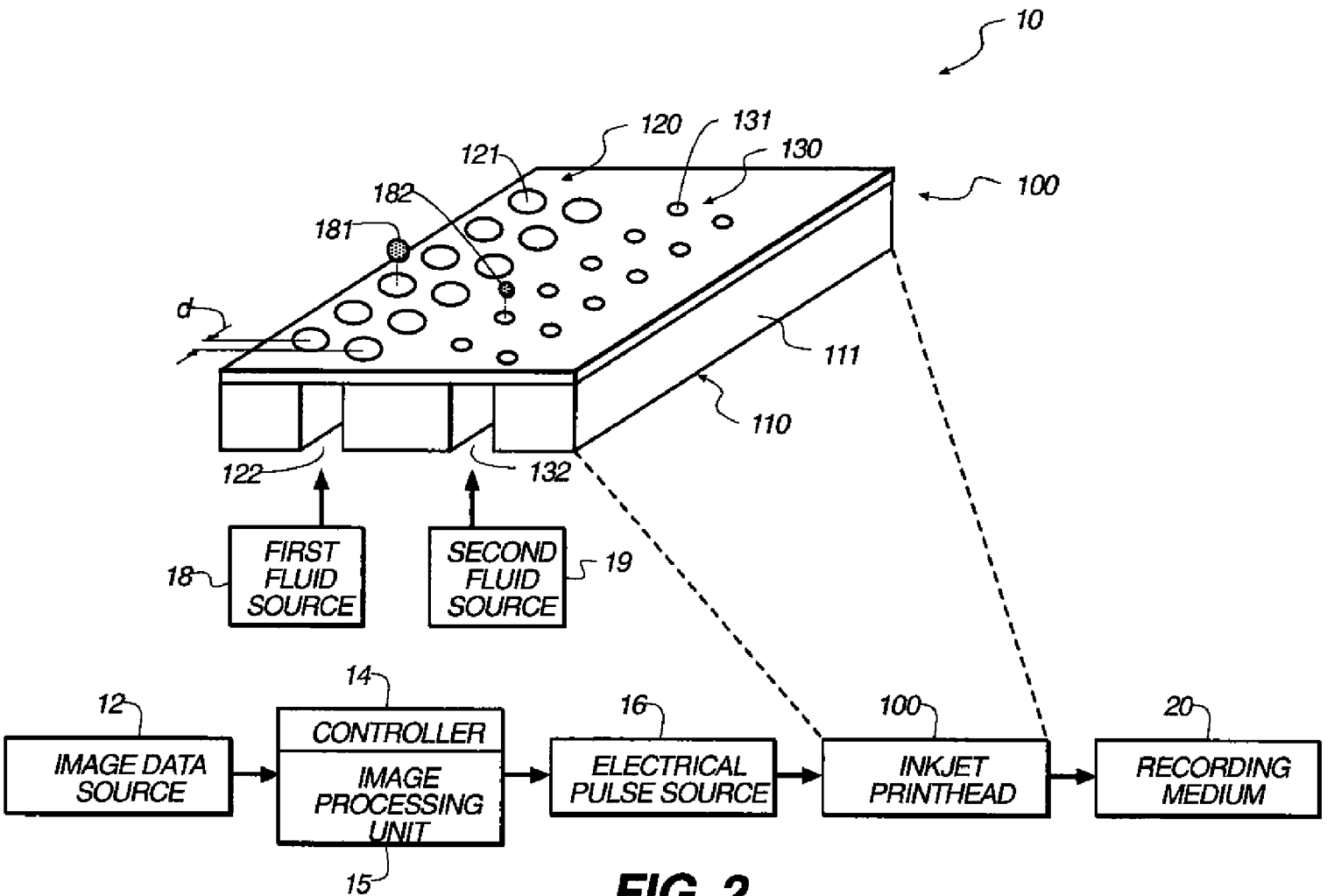
FIG. 2 schematically shows an inkjet printer system.

Referring to FIG. 2, a schematic representation of an inkjet printer system 10 is shown, for its usefulness with the present invention and is fully described in U.S. Pat. No. 7,350,902 which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 2, there are two nozzle arrays 120 and 130 that are each disposed along a nozzle array direction 254. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 2). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 2 as openings through printhead die substrate 111. One or more inkjet printhead die 110 will be included in inkjet printhead 100, but for greater clarity only one inkjet printhead die 110 is shown in FIG. 2. The printhead die are arranged on a mounting support member as discussed below relative to FIG. 3. In FIG. 2, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132, respectively. Also, in some embodiments, fewer than two or more than two nozzle arrays can be included on inkjet printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 2. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 2, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20 (also sometimes called paper, print medium or medium herein).

Figure 3:
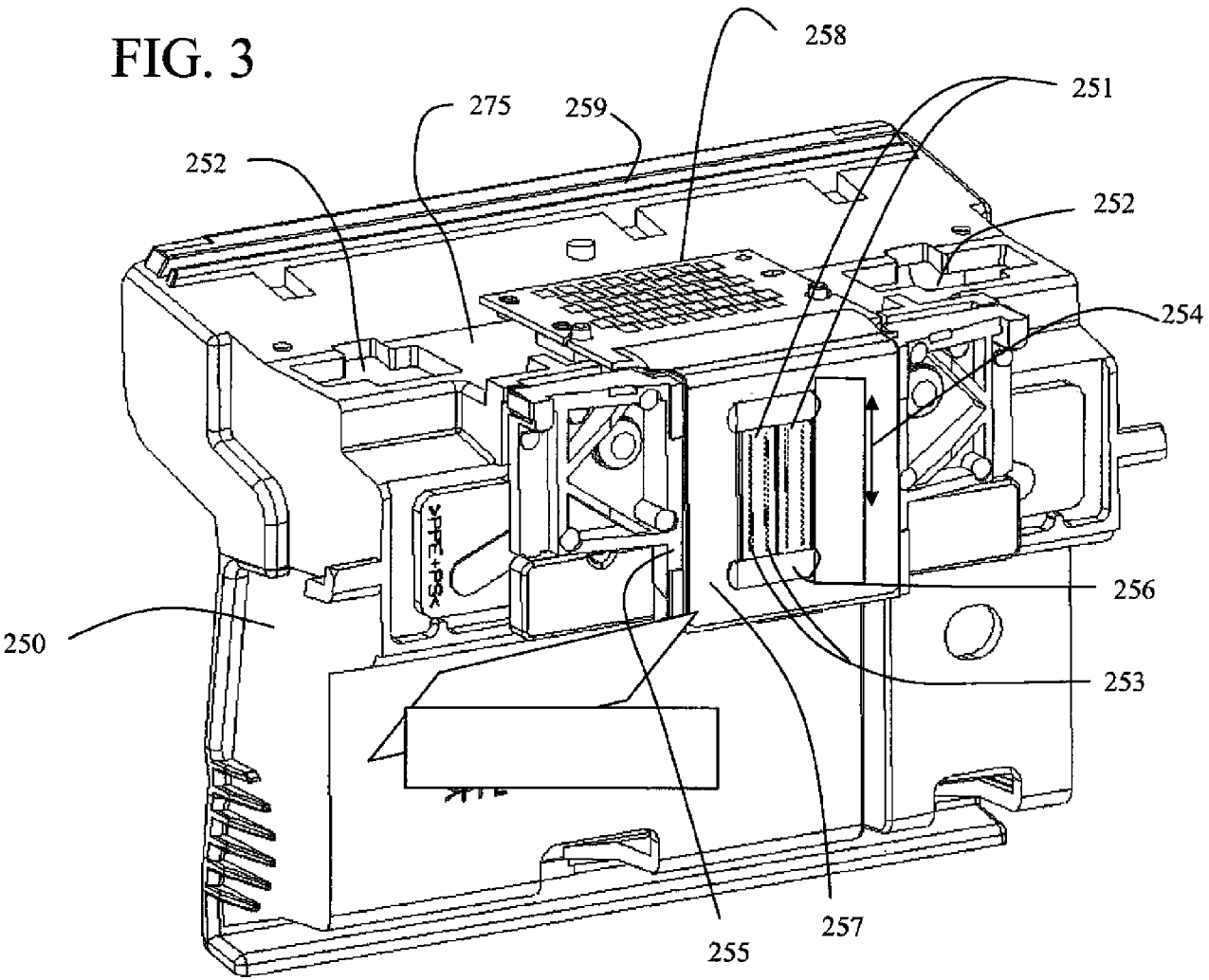
FIG. 3 is a perspective view of a printhead.

FIG. 3 shows a perspective view of a portion of a printhead 250, which is an example of an inkjet printhead 100. Printhead 250 includes two printhead die 251 (similar to inkjet printhead die 110 of FIG. 2) that are affixed to a common mounting support member 255. Each printhead die 251 contains two nozzle arrays 253, so that printhead 250 contains four nozzle arrays 253 altogether. The four nozzle arrays 253 in this example can each be connected to separate ink sources. Each of the four nozzle arrays 253 is disposed along nozzle array direction 254, and the length of each nozzle array along nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 3 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 5), connector board 258 is electrically connected to a connector 244 on the carriage 200, so that electrical signals can be transmitted to the printhead die 251.

Figure 4:
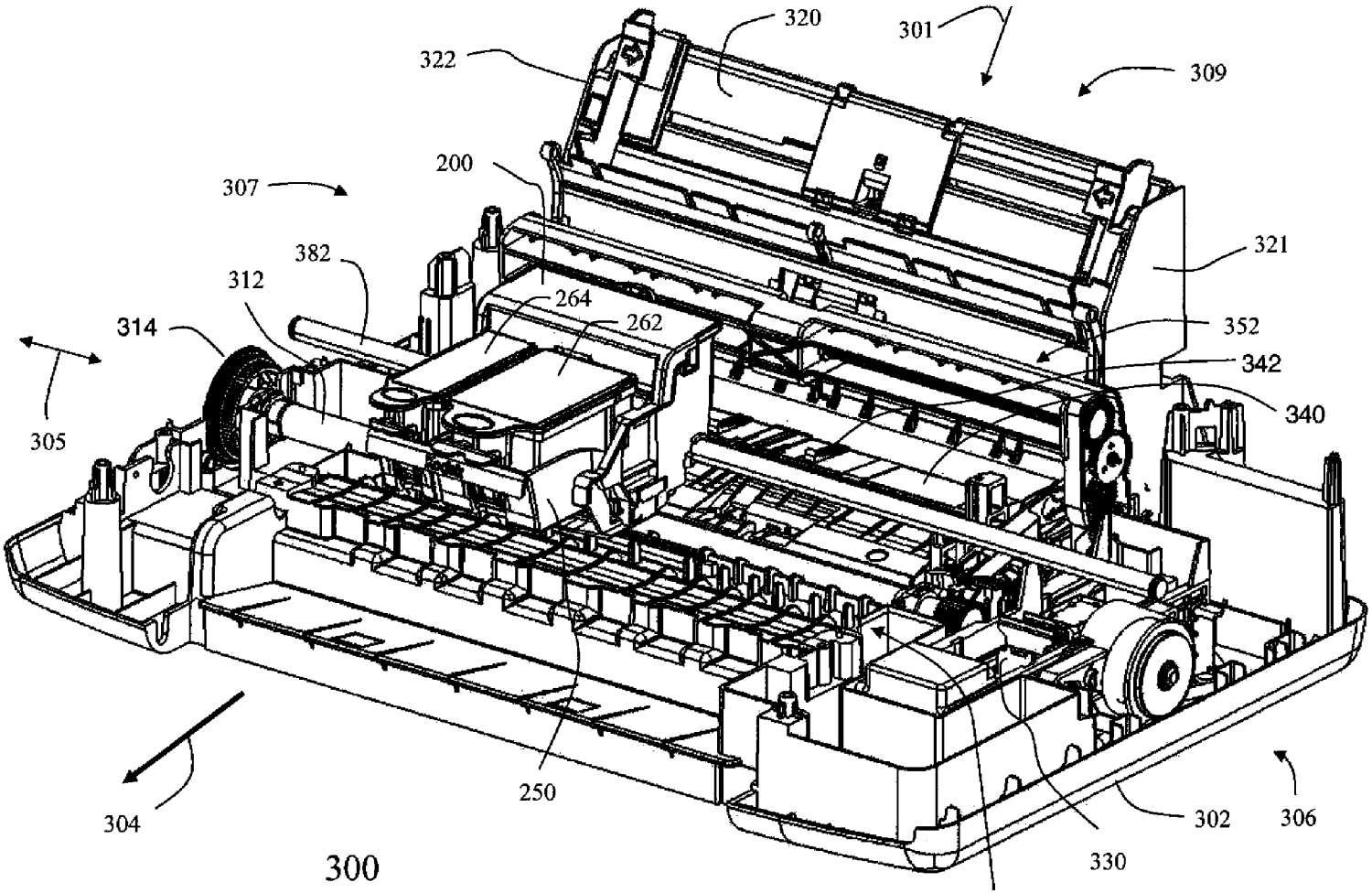
FIG. 4 is a perspective view of the printer of the present invention.

FIG. 4 shows a portion of a desktop carriage printer. Some of the parts of the printer have been hidden in the view shown in FIG. 4 so that other parts can be more clearly seen. Printer chassis 300 includes a horizontal base 302. Carriage 200 is moved back and forth in carriage scan direction 305, between the right side 306 and the left side 307 of printer chassis 300, while drops are ejected from printhead die 251 (not shown in FIG. 4) on printhead 250 that is mounted on carriage 200. A carriage motor (not shown) moves carriage 200 along carriage guide rail 382.

Printhead 250 is mounted in carriage 200, and multi-chamber ink supply 262 and single-chamber ink supply 264 are mounted in the printhead 250. The mounting orientation of printhead 250 is rotated relative to the view in FIG. 3, so that the printhead die 251 are located at the bottom side of printhead 250, the droplets of ink being ejected downward in the view of FIG. 4. Multi-chamber ink supply 262, for example, contains three ink sources: e.g. cyan, magenta, and yellow ink; while single-chamber ink supply 264 contains black ink. Toward the right side 306 of the printer chassis 300, in the example of FIG. 4, is the maintenance station 330.

Figure 1:
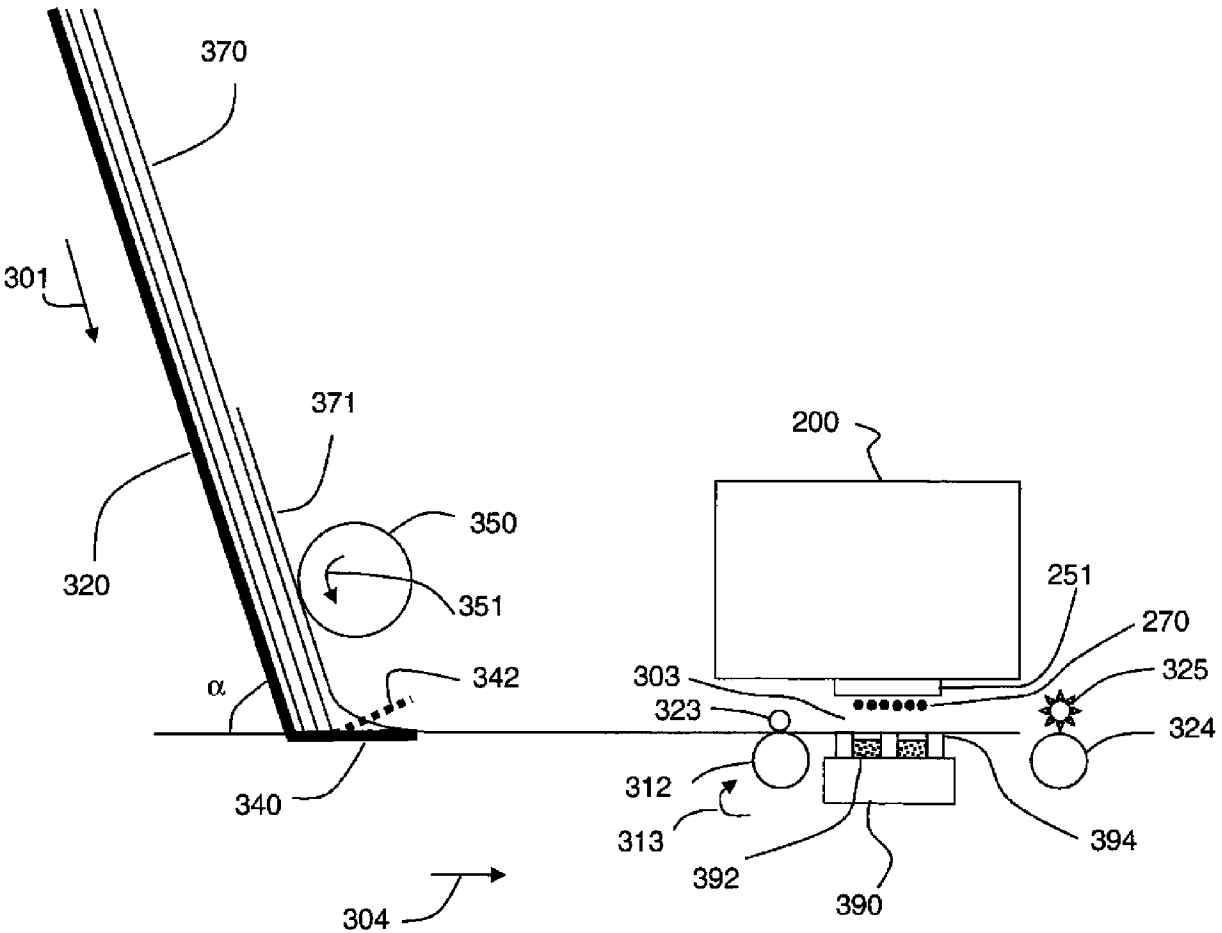
FIG. 1 PRIOR ART
FIG. 1 is a schematic side view of a prior art printer having an L-shaped paper path.
Figure 9:
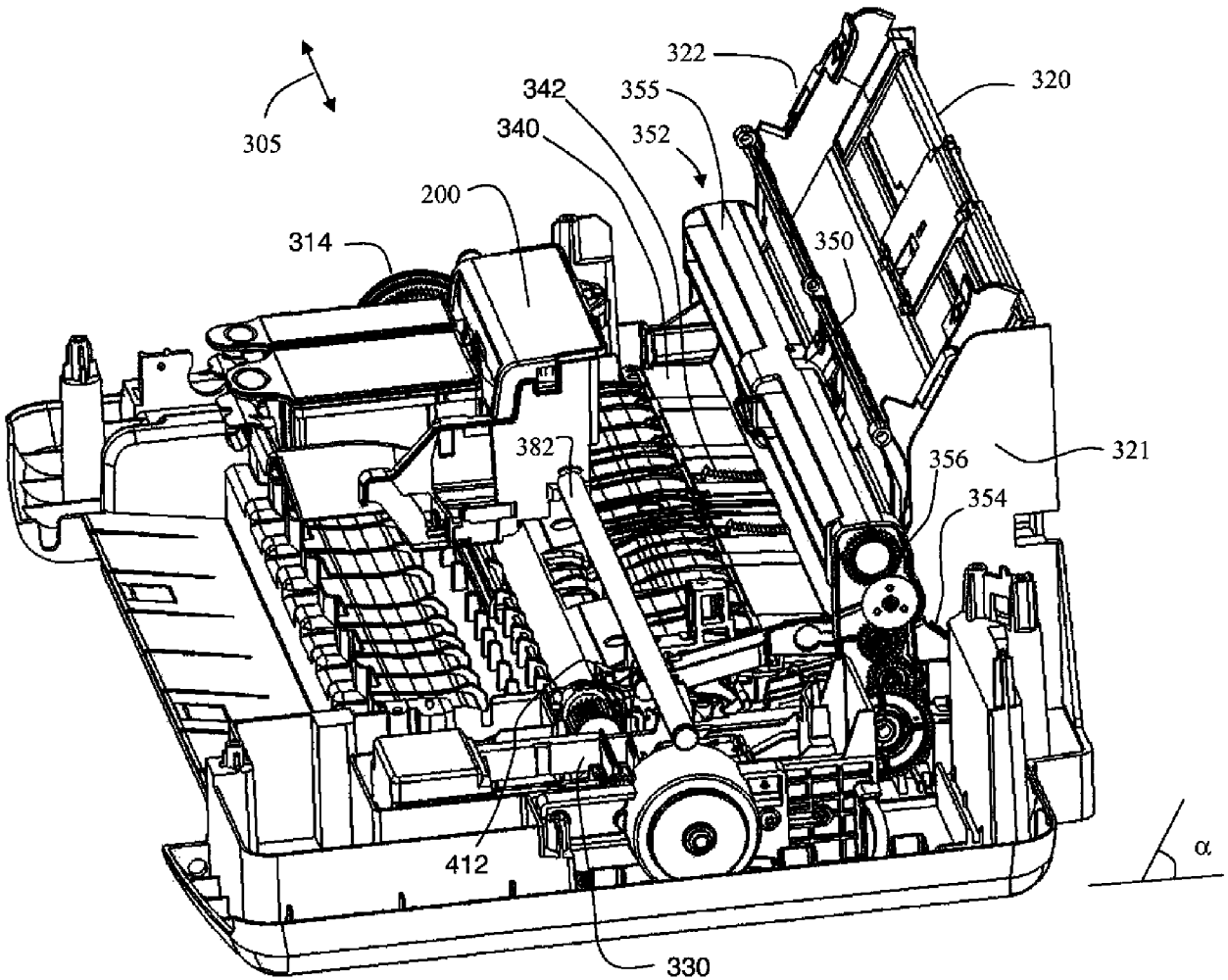
FIG. 9 is a side perspective view of a portion of an inkjet printing system with the pick arm assembly biased to pivot toward the media input support according to a preferred embodiment of the present invention.

In the L-shaped paper path shown in FIGS. 1, 4 and 9, the recording medium would be loaded along paper load entry direction 301 nearly vertically at an angle $\alpha$ of 60 degrees or more relative to horizontal base 302 (or relative to media retention plate 340, which is substantially parallel to base 302 in the example of FIG. 4) against media input support 320 at the rear 309 of the printer chassis. Media input support 320 includes a first side 321 and a second side 322. Media stopper elements 342 extend upwardly at an angle from media retention plate 340 in FIGS. 4 and 9. Throughout the present specification, the stopper element or elements are intended to include elements of various physical design including friction surfaces of various materials, for example, polymers or rubber, and patterned surfaces, for example, serrated surfaces which are depicted in the drawings herein. Several rollers are used to advance the recording medium through the printer. A pick roller 350 on pick arm assembly 352 is rotated in rotation direction 351 to move the first piece or sheet 371 of a stack 370 of paper or other recording medium in media input support 320 from paper load entry direction 301 to the media advance direction 304 past media retention plate 340 and toward feed roller 312. During pick roller rotation, the media stopper elements 342 are retracted into media retention plate 340 as described below. The paper is then moved by feed roller 312 (as it is rotated in forward rotation direction 313) and idler roller(s) 323 to advance toward the print region 303 (disposed along carriage scan direction 305). Because the pick roller 350 contacts a top side of the piece 371 of recording medium and the feed roller 312 contacts the opposite side, the rotation direction 351 of pick roller 350 is opposite the forward rotation direction 313 of feed roller 312 in order to advance piece 371 of recording medium through the printer. Feed roller 312 is driven directly by a paper advance motor (not shown) that is connected by belt or gear engagement, for example at drive gear 314. After the image is printed at print region 303, the piece 371 of recording medium is further advanced to a discharge roller 324 and star wheel(s) 325.

Figure 5:
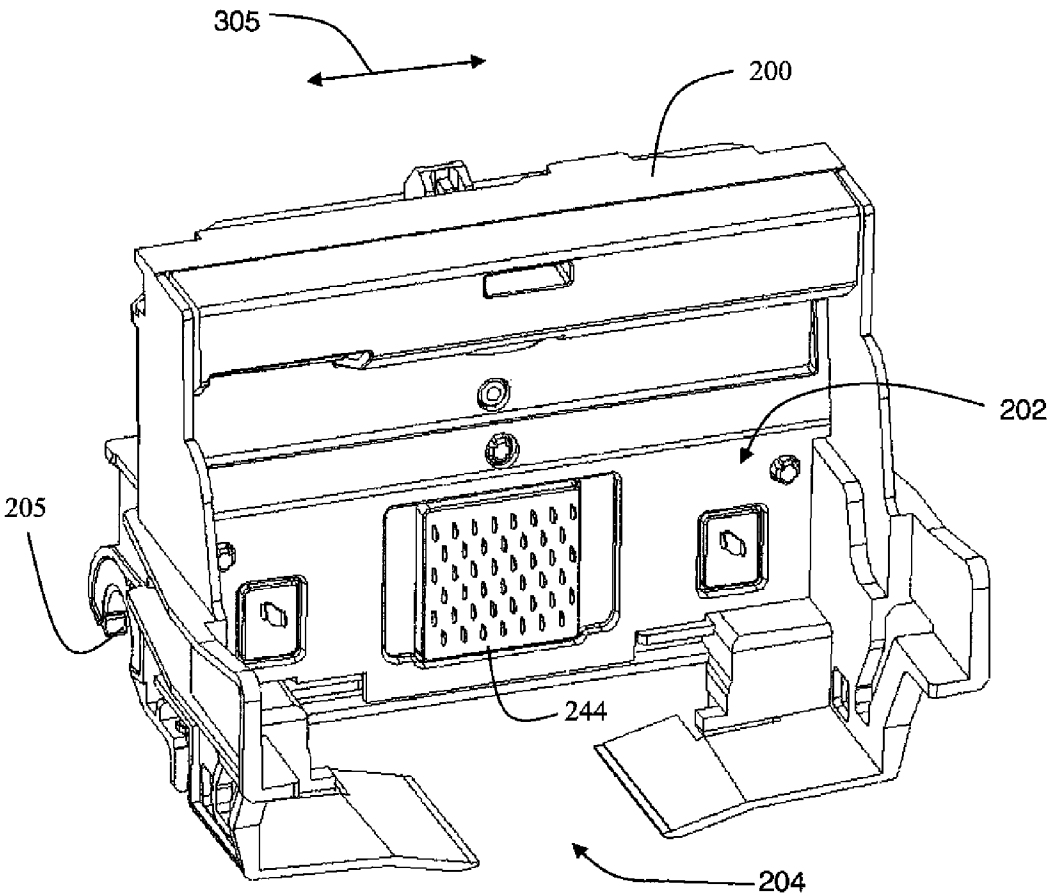
FIG. 5 is a perspective view of a carriage of the printer of the present invention.
Figure 7:
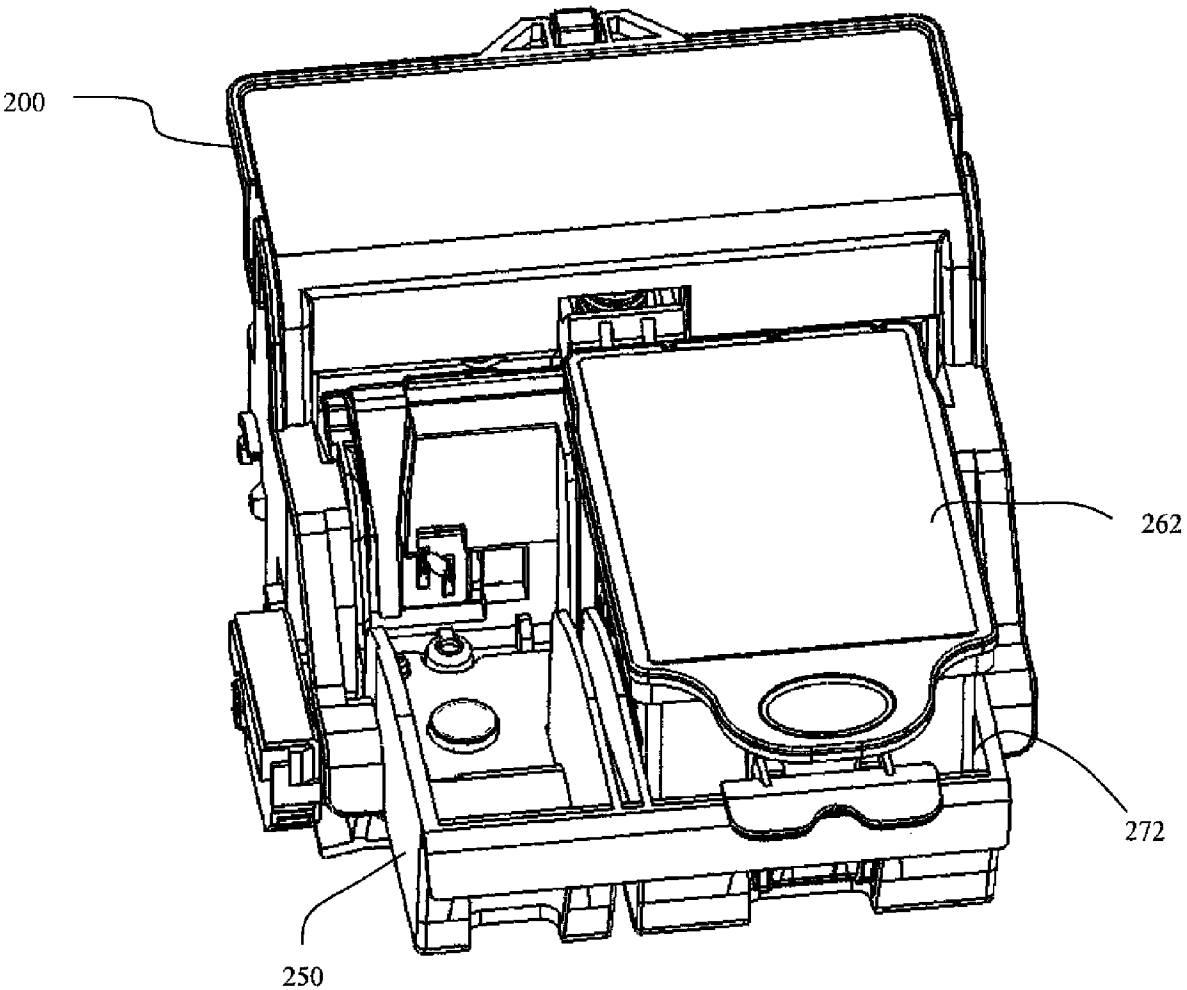
FIG. 7 is a perspective view of an ink tank loaded into the printhead of FIG. 6.
Figure 8:
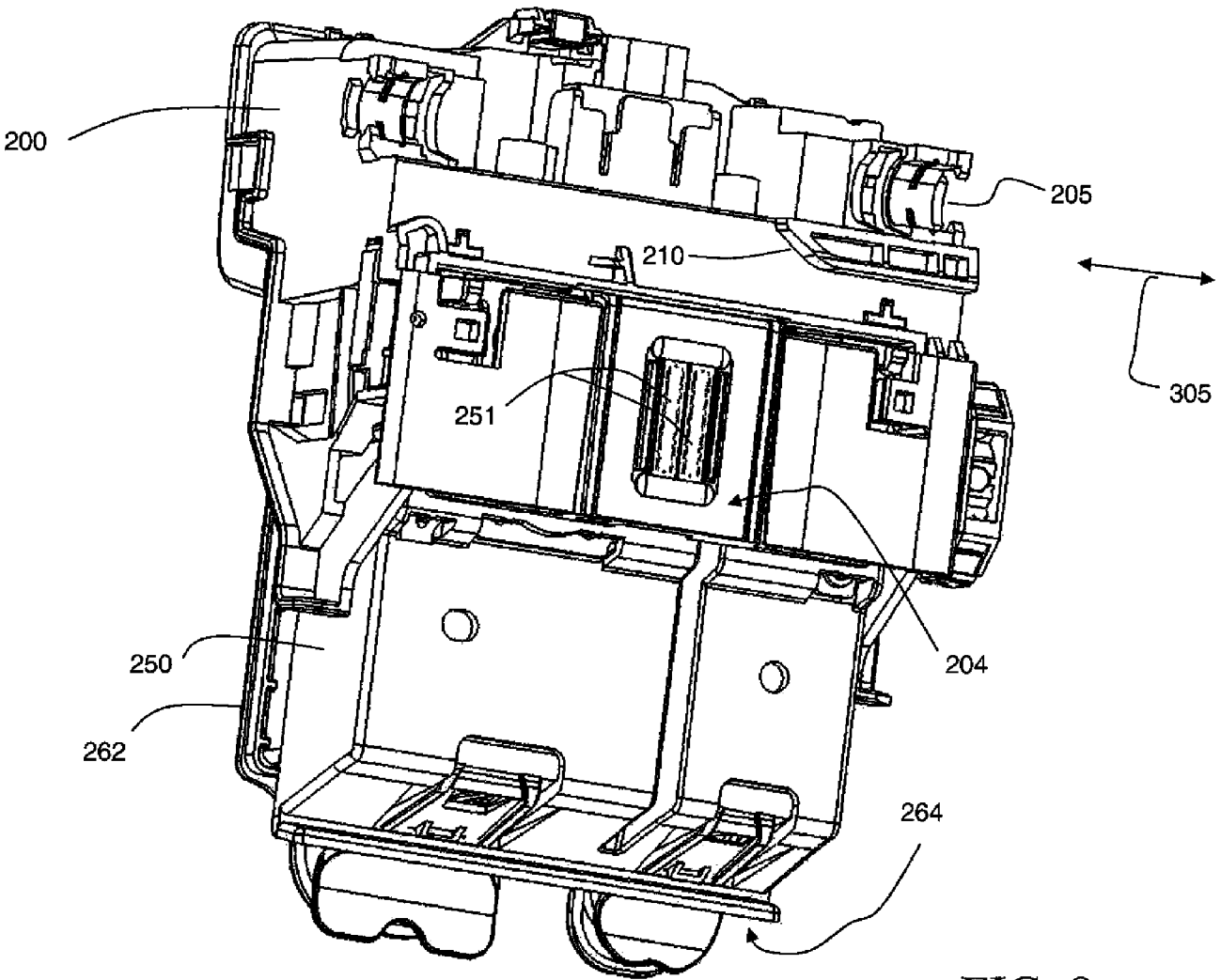
FIG. 8 a perspective view of the carriage, printhead and ink tanks, rotated with respect to FIGS. 5-7.

FIG. 5 is a perspective view of carriage 200. Carriage 200 includes a holder 202 for an inkjet printhead 250 (see FIGS. 3, 6-8). Printhead die 251 are exposed through window 204 of carriage 200 when printhead 250 is mounted onto carriage 200 (FIG. 8). Carriage 200 includes one or more bushings 205 to glide along carriage guide rode 382 (FIG. 4) in carriage scan direction 305. Carriage 200 also includes a connector 244 to mate with connector board 258 of printhead 250 (FIG. 3).

Figure 6:
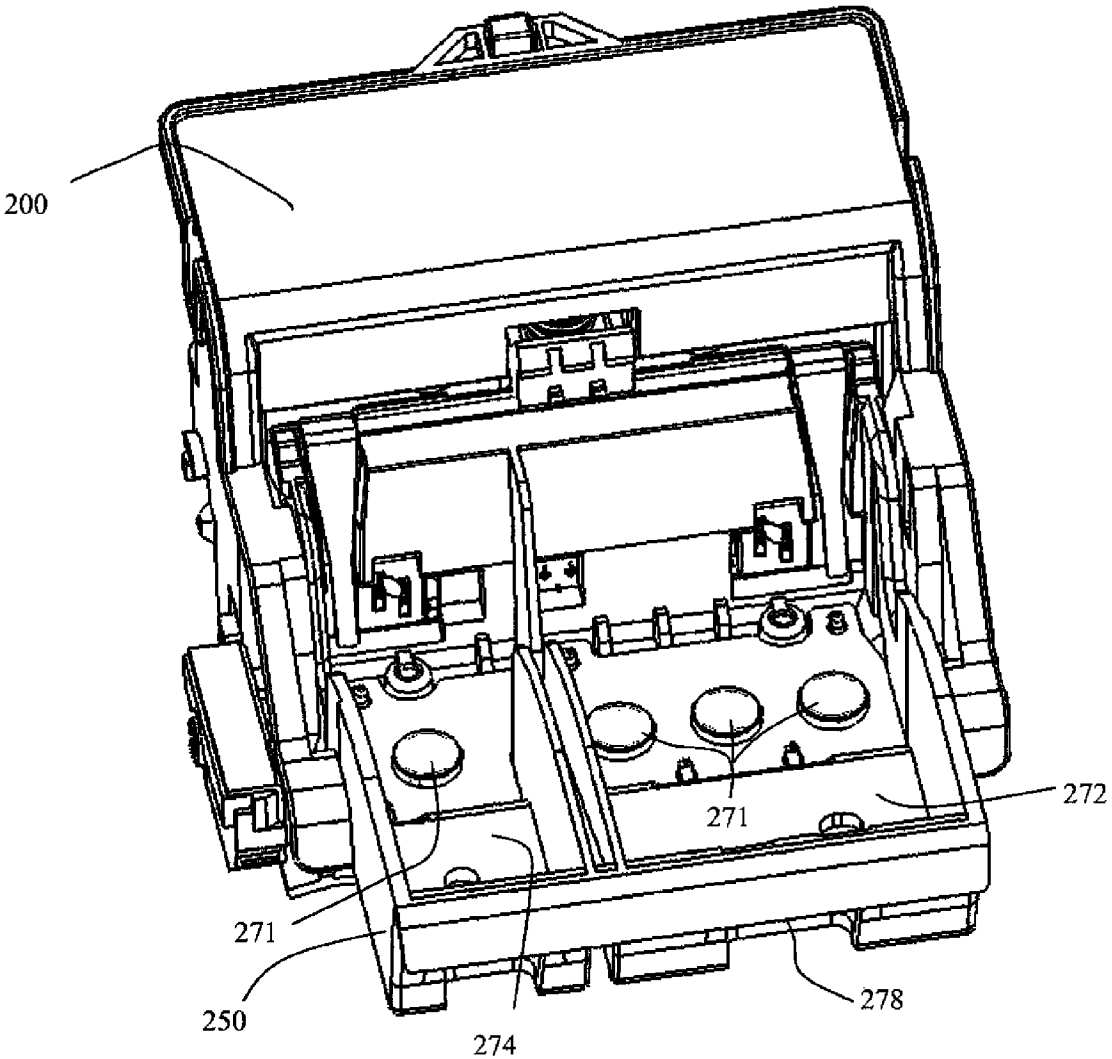
FIG. 6 is a perspective view a printhead mounted onto the carriage of FIG. 5.

FIG. 6 is a perspective view of printhead 250 mounted in carriage 200. Printhead 250 includes compartment 272 for multi-chamber ink supply 262 (FIGS. 3 and 8) and compartment 274 for single chamber ink supply 264. Ink ports 271 receive ink from the ink supplies 262 and 264 and provide the ink to printhead die 251 of printhead 250. FIG. 7 shows a perspective view of multi-chamber ink supply 262 loaded into compartment 272 of printhead 250.

FIG. 8 is a bottom perspective view of the underside of carriage 200 together with printhead 250 and ink supplies 262 and 264. A feature shown in FIG. 8 that is a preferred embodiment of the present invention is sloped feature 210 that is sloped relative to carriage scan direction 305 and that is in line along carriage scan direction 305 with a corresponding ramped feature 412 (described below with reference to FIGS. 9 and 13), such that when sloped feature 210 is engaged with the ramped feature 412, the pivotable pick arm assembly 352 (including pick roller 350) is pivoted in a direction away from media input support 320 (FIG. 4).

Figure 12:
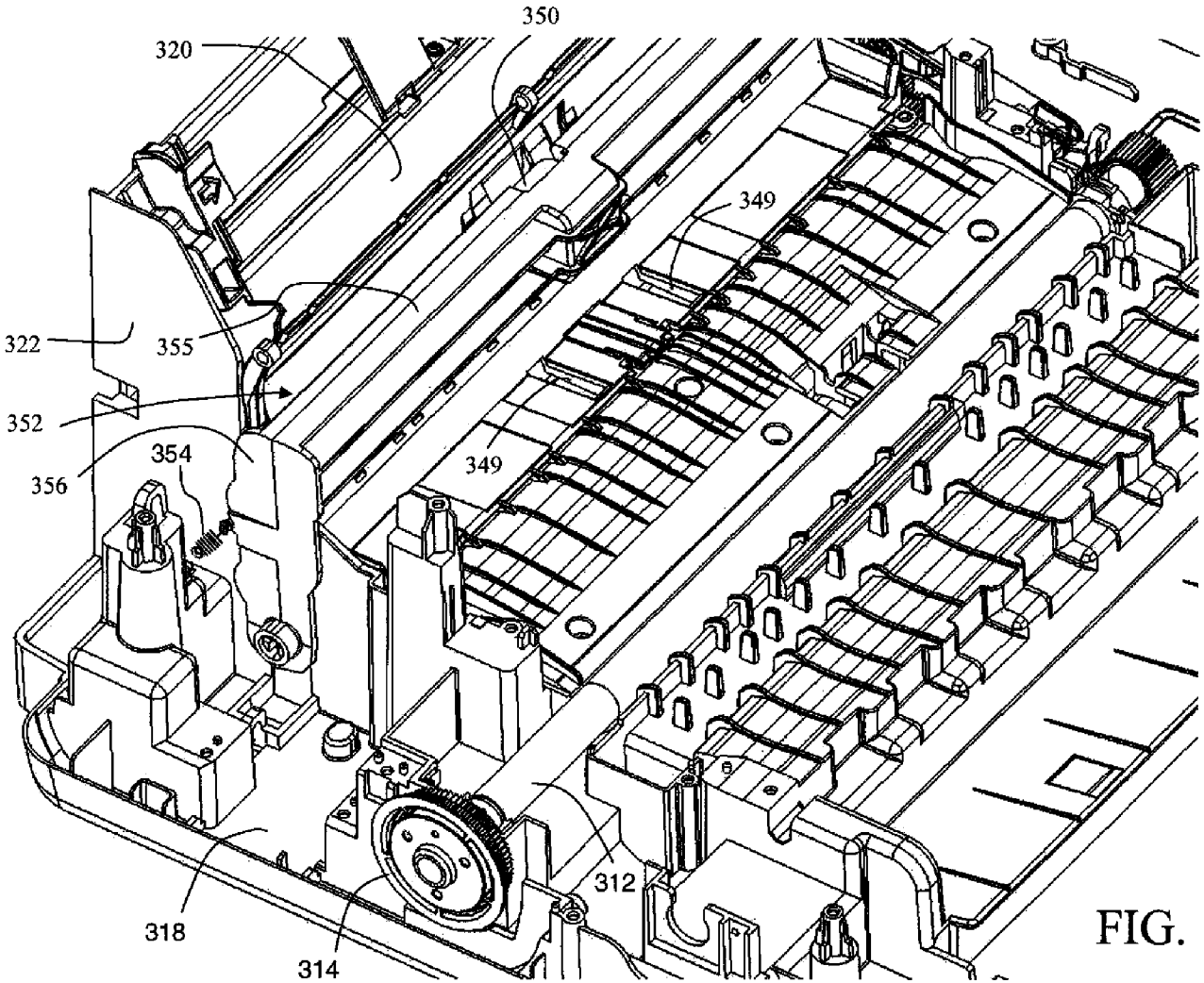
FIG. 12 is a side perspective view from an opposite side relative to FIG. 9.

FIG. 9 is a side perspective view (from right side 306 of FIG. 4) of a portion of an inkjet printing system with the pick arm assembly 352 biased to pivot toward the media input support 320 according to a preferred embodiment of the present invention. Pick arm assembly 352 including pick roller 350, pick roller support arm 355 and support legs 356, is biased toward media input support 320 by biasing spring 354 located near but beyond the first side 321 of media input support 320. Biasing spring 354 is attached to pivotable support leg 356. The biasing support leg 356 near first side 321 has a number of gears mounted on it for transmitting rotational motion to the pick roller 350. A second biasing spring 354 is located near but beyond the second side 322 of media input support 321 as shown in FIG. 12, so that pick roller 350 is disposed between the two biasing springs 354. The biasing support leg 356 near second side 322 does not have gears attached to it (see FIG. 12). Pick roller support arm 355 is substantially parallel to carriage scan direction 305 and extends beyond the first side 321 and the second side 322 of media input support 320 in order to provide attachment points for the two biasing springs 354 at support legs 356 without interfering with the passage of recording medium (not shown). In FIG. 9, carriage 200 is not at its home position near maintenance station 330, so the sloped feature 210 (see FIG. 8) is not engaged with the ramped feature 412 located near maintenance station 330. As a result, biasing springs 354 hold pivotable pick arm assembly 352 so that pick roller 350 is against media input support 320, or against a top piece 371 of media (not shown) at media input support 320. This is the desirable position of the pick roller 350 for moving recording medium from media input support 320. However, if the user attempts to load a few sheets of recording medium having low stiffness while the pick roller 350 is biased against the media input support 320, the recording medium may become wrinkled or damaged while trying to load it.

Figure 10:
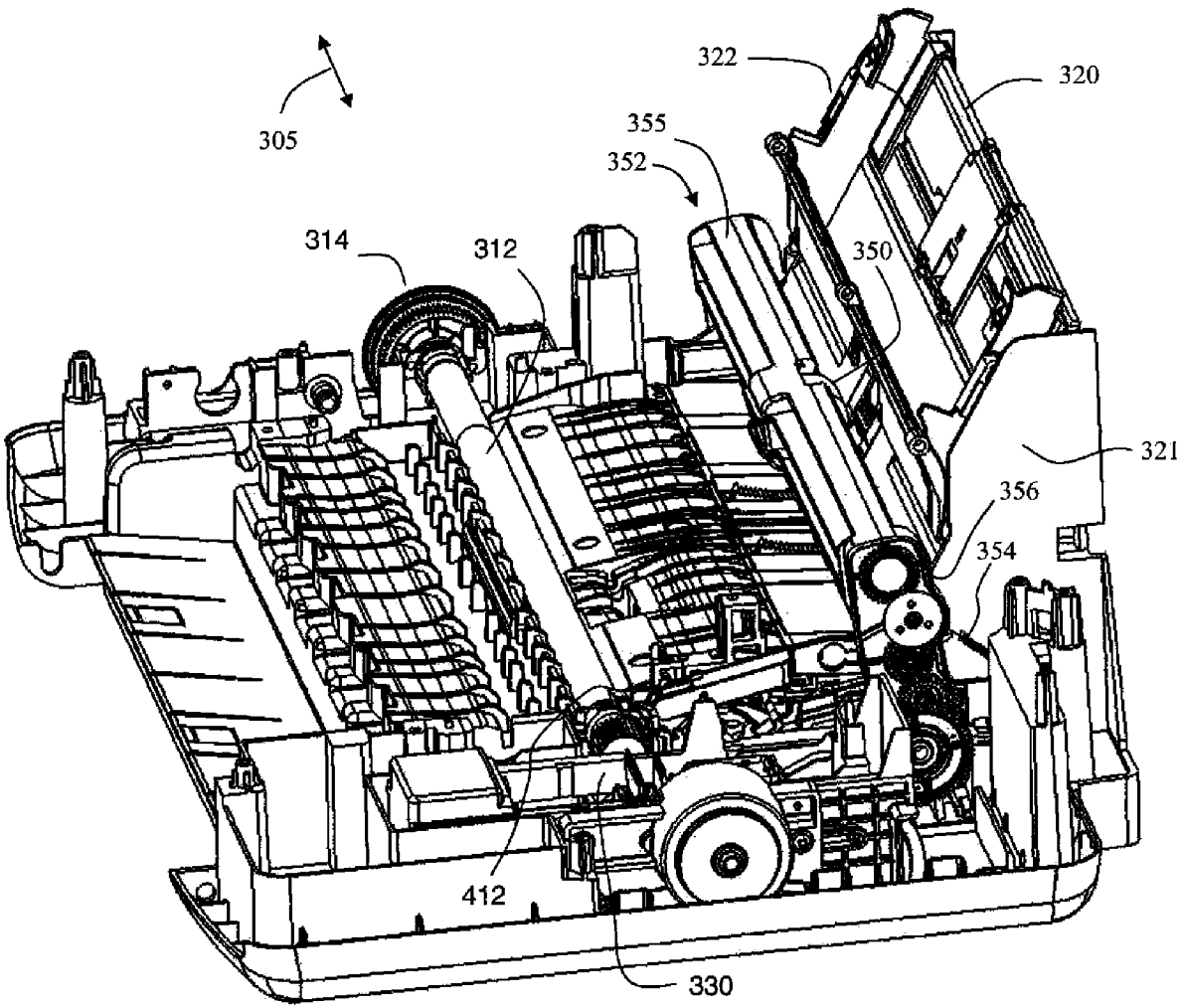
FIG. 10 is a side perspective view of a portion of the inkjet printing system of FIG. 9 with the pick arm assembly pivoted away from the media input support according to a preferred embodiment of the present invention.

Typically a user will load paper between printing jobs when the carriage 200 is at its home position at the maintenance station 330. FIG. 10 is a side perspective view of a portion of the inkjet printing system of FIG. 9 with the pick arm assembly 352 pivoted away from the media input support 320 according to a preferred embodiment of the present invention. The carriage 200 and the carriage guide rail 382 are hidden in the view of FIG. 10 so that the ramped feature 412 can be seen more clearly. The ramped feature 412, having been engaged by the sloped feature 210 on the carriage 200 as the carriage approaches the home position overcomes the biasing force of the biasing springs 354 and pivots the pivot arm assembly 352, including pick roller 350, away from media input support 320, as is described in further detail below. The amount of gap provided between the pick roller 350 and the media input support does not need to be large. It has been found that a gap of more than 2 mm (and up to 6 mm or more) is achievable in this manner. A 6 mm gap can accommodate approximately 60 sheets of media having a thickness of about 100 microns (i.e. about 0.004 inch). Even if the sheets individually have low stiffness, a stack of sheets has sufficient combined stiffness not to become wrinkled or damaged.

Figure 11:
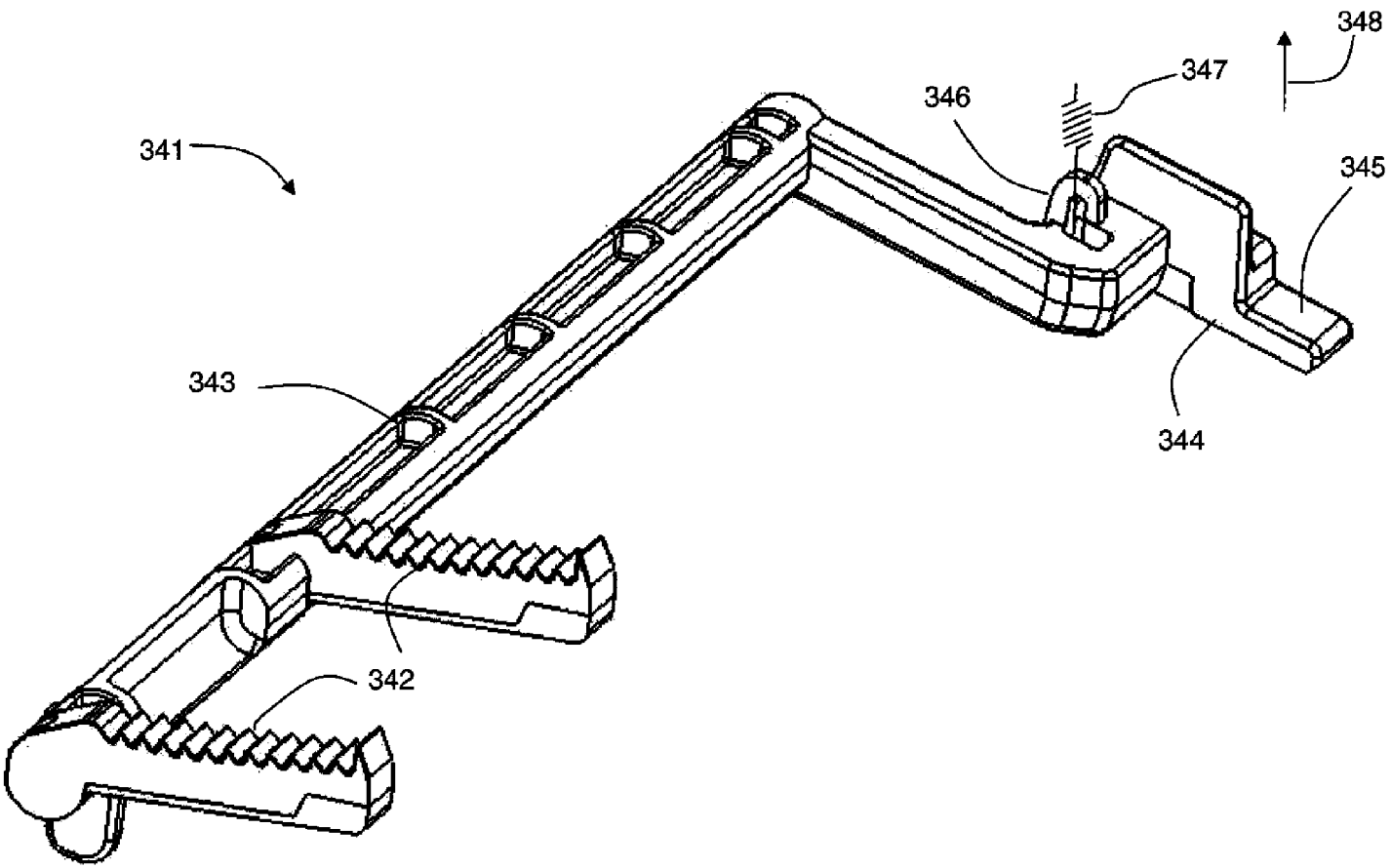
FIG. 11 is a close-up perspective view of a media stopper according to a preferred embodiment of the present invention.

FIG. 11 is a close-up perspective view of a media stopper 341 according to a preferred embodiment of the present invention. Media stopper 341 includes a rotatable shaft 343 from which media stopper elements 342 extend. Near an end of rotatable shaft 343 is a lever 344 having a first contact surface 345. In this example, first contact surface 345 is a flat surface on the upper side of lever 344. A spring attachment feature 346 extends from lever 344. A spring 347 attaches to spring attachment feature 346 and biases the lever 344 upwardly along biasing direction 348, so that media stopper elements 342 normally extend upwardly through slots in media retention plate 340 as seen in FIGS. 4 and 9. As described below, in order to retract the media stopper elements 342 into media support plate 340, sufficient force must be applied to the first contact surface 345 of lever 344 in a direction opposite biasing direction 348 to overcome the biasing force of spring 347.

FIG. 12 is a side perspective view (from left side 307 of FIG. 4) of a portion of an inkjet printing system with the pick arm assembly 352 biased to pivot toward the media input support 320 as in FIG. 9. The second biasing spring 354 attached to support leg 356 located near second side 322 of media input support 320 can be seen in this view. In FIG. 12 media stopper elements 342 are hidden in order to more clearly show the slots 349 into which the media stopper elements retract during rotation of the pick roller 350, as described below. The media advance motor that powers drive gear 314 for feed roller 312 is hidden in FIG. 12, but the motor mount region 318 is indicated. The carriage is also hidden in this view.

Figure 13:
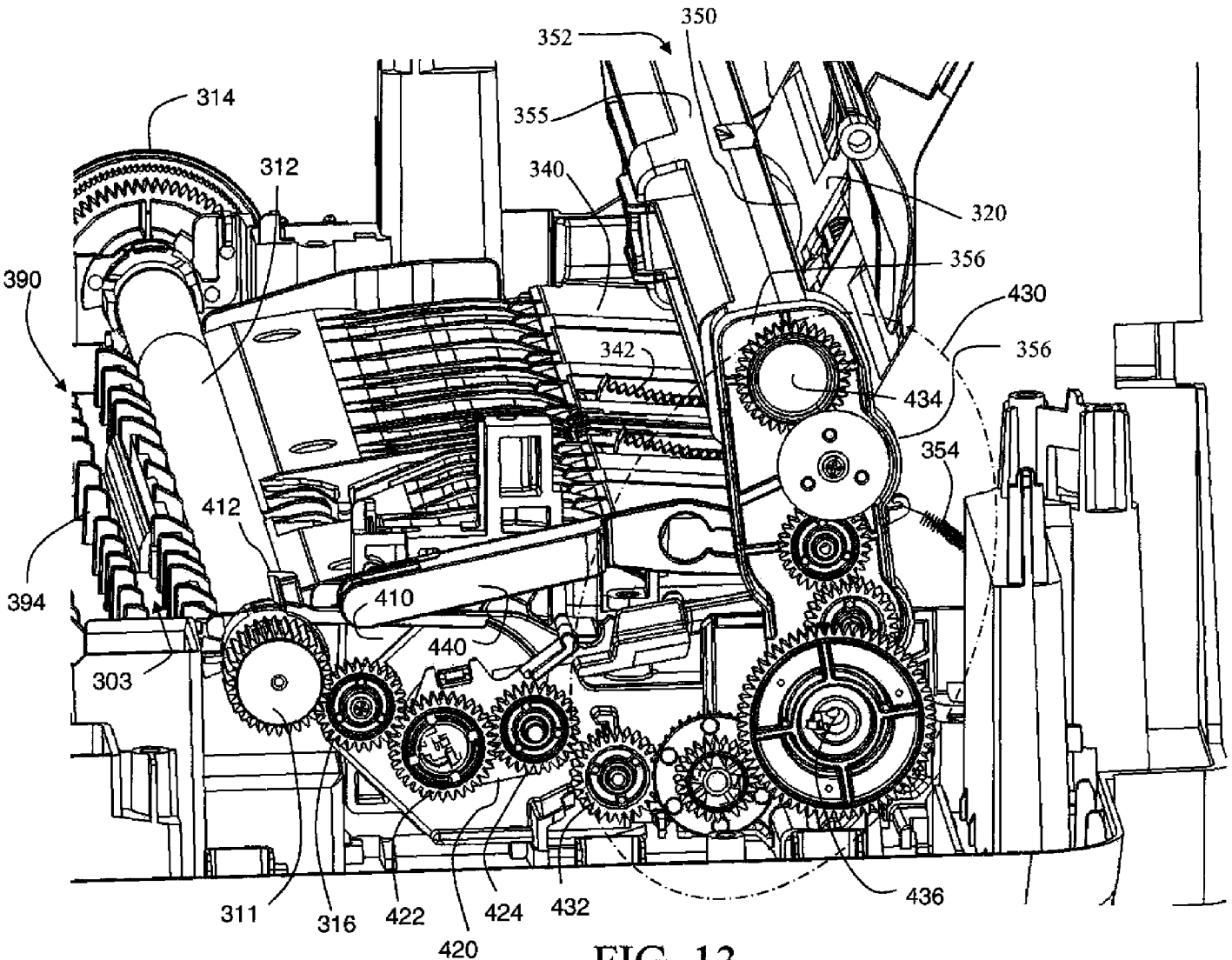
FIG. 13 is a close-up side perspective view similar to FIG. 10 with the pick arm assembly held away from the media input support.

FIG. 13 is a close-up side perspective view similar to FIG. 10 with the pick arm assembly 352 held away from the media input support 320. In FIG. 13, both the carriage and the maintenance station are hidden in order to more clearly show further details, including platen 390 (along print region 303), support ribs 394, pick clutch assembly 420, and gear train 430. In this close-up view it is also easier to see the gap between pick roller 350 and media input support 320 when the carriage is in the home position to pivot the pick arm assembly 352 away from media input support 320. Ramped feature 412 is a part of a rotatable arm 410 that is described in more detail below with reference to FIGS. 17-19. (By a "rotatable" arm herein is meant an arm that can rotate or pivot in an arc about an axis, and does not imply that the arm can rotate in a full circle.) Rotatable arm 410 is linked to pick arm assembly 352 by link arm 440. Power to rotate pick roller 350 is controllably provided by the media advance motor that drives feed roller 312 via drive gear 314 mounted on one end of the shaft of feed roller 312. Feed roller gear 311 is coaxially mounted on the opposite end of shaft. Idle gear 316 is always engaged with feed roller gear 311 and with first gear 422 of pick clutch assembly 420. In other words, first gear 422 of pick clutch assembly 420 is located proximate feed roller gear 311, but it is only indirectly engaged with feed roller gear 311 in this embodiment through idle gear 316. (In other embodiments, not shown, having no idle gear 316, the first gear 422 of pick clutch assembly can be directly engaged with feed roller gear 311.) Second gear 424 of pick clutch assembly 420 is engaged with first gear 422 and is selectively engageable with engaging gear 432 of gear train 430 (which includes the gears within the dashed line oval in FIG. 13). As described in more detail below, when the sloped feature 210 (FIG. 8) engages ramped feature 412, not only is pick arm assembly 352 pivoted about pivot point 436 on support leg 356, but also second gear 424 of pick clutch assembly 424 is held away from engaging gear 432 of gear train 430, so that no power is transferred to gear train 430. In particular, pick roller gear 434 is not rotated, so no rotational power is provided to pick roller 350. As described in more detail below, the application of force to first contact surface 345 of lever 344 (see FIG. 11) in order to overcome the biasing force of spring 347 is not provided unless the pick clutch assembly 424 is engaged with gear train 430 and pick roller 350 is being rotated. In other words, in the configuration of FIG. 13 with the carriage in the home position and holding the pick arm assembly 352 away from media input support 320, the biasing force of spring 347 will keep media stopper elements 342 extending upwardly from media retention plate 340.

Figure 14:
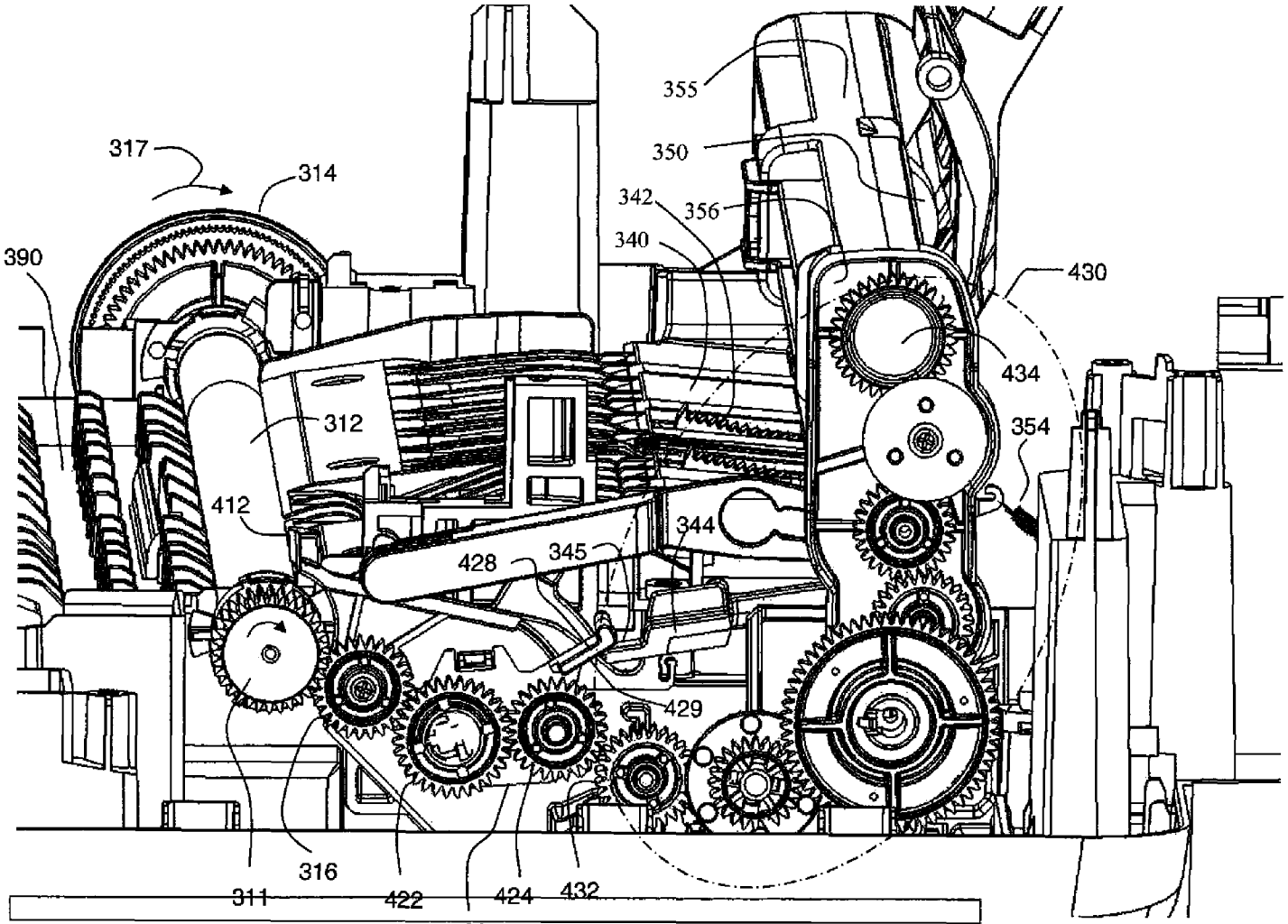
FIG. 14 is a close-up side perspective view with the pick arm assembly biased against the media input support and the pick clutch assembly rotating toward engagement with the gear train.
Figure 15:
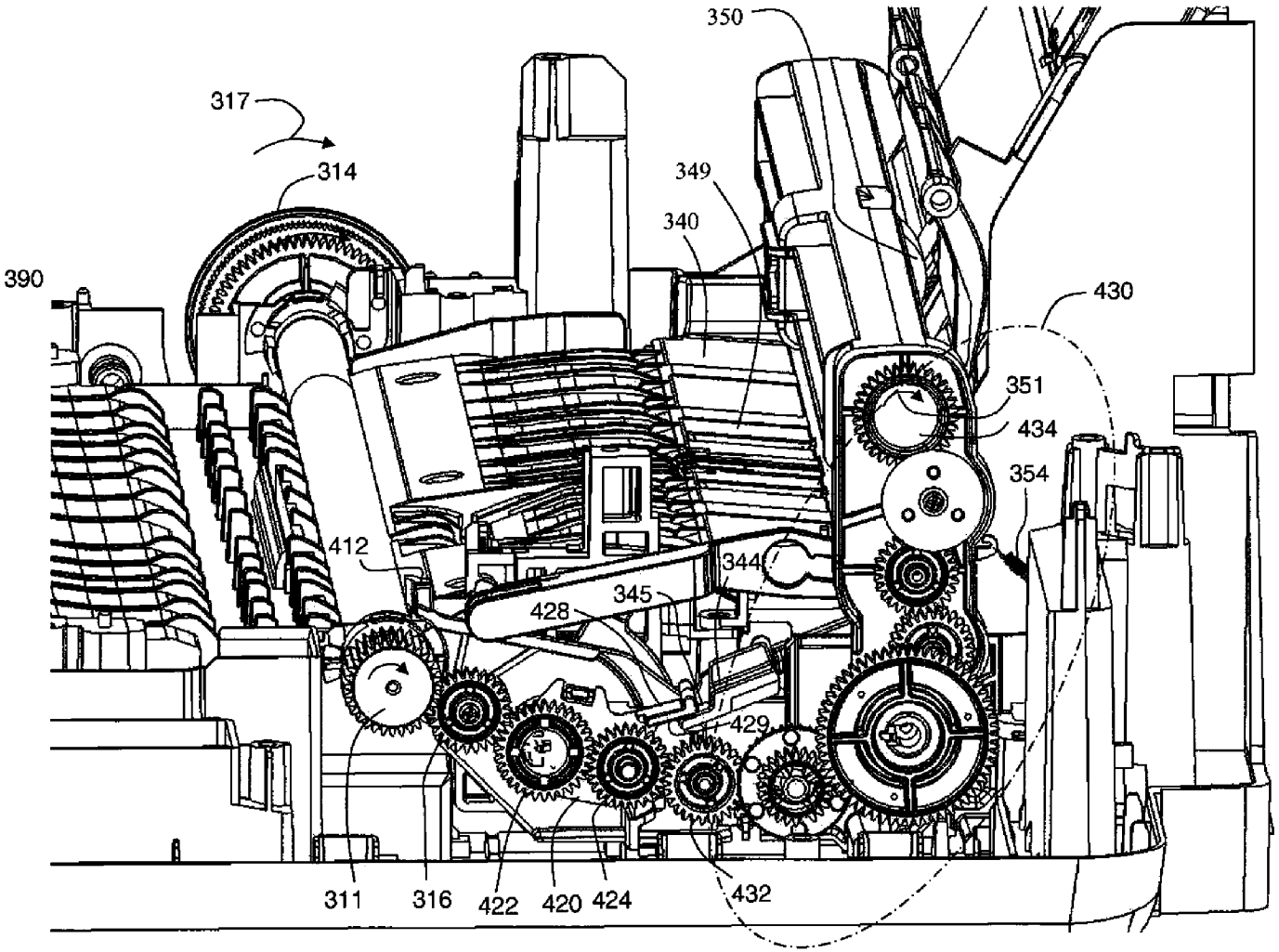
FIG. 15 is a close-up side perspective view with the pick arm assembly biased against the media input support and the pick clutch assembly fully engaged to cause the media stopper to retract.

FIGS. 14 and 15 are a sequence showing how the second gear 424 of pick clutch assembly 420 becomes engaged with engaging gear 432 of gear train 430 in order to provide rotational power to the pick roller and also provide the force on lever 344 of media stopper 341 in order to retract media stopper elements 342 according to a preferred embodiment of the present invention. In both FIGS. 14 and 15 the carriage (not shown) has been moved out of the home position so that ramped feature 412 is no longer engaged by the sloped feature on the underside of the carriage, so that pick arm assembly 352 is biased against the media input support. In FIG. 14 drive gear 314 is being driven in the reverse direction 317, causing both feed roller 312 and feed roller gear 311 also to be driven in the reverse direction (indicated by the arrow on the face of feed roller gear 311). The rotation of feed roller gear 311 in reverse direction cause the idler gear 316 and first gear 422 of pick clutch assembly 420 also to rotate, which causes pick clutch assembly 420 to rotate downward such that second gear 424 of pick clutch assembly 420 approaches engaging gear 432 of gear train 430. Pick clutch assembly includes an arm 428 having a second contact surface 429 on its bottom side, which is flat in the example shown in FIG. 14. As pick clutch assembly 420 rotates downward, second contact surface 429 of arm 428 approaches first contact surface 345 of lever 344. In FIG. 14, the second gear 424 of pick clutch assembly 420 is nearly engaged with engaging gear 432 but not quite, so no power is being transmitted to gear train 430. Even if second contact surface 429 of arm 428 touches first contact surface 345 of lever 344, insufficient torque would be generated to overcome the force of spring 347 in direction 348 before pick clutch assembly 420 is engaged with gear train 430, so the media stopper elements 342 continue to be biased to extend upward from media retention plate 340.

In FIG. 15, after continued reverse rotation of drive gear 314, feed roller 312 and feed roller gear 311, pick clutch assembly 420 has rotated into full engagement so that second gear 424 is engaged with engaging gear 432 of gear train 430. As a result, rotational power is transmitted through gear train 430 causing pick roller gear 434 and pick roller 350 to rotate in rotation direction 351 to move a piece of media (not shown) toward feed roller 312. As second gear 424 pushes against engaging gear 432 to transmit rotational power to gear train 430 and rotate pick roller 350, sufficient torque is now provided for second contact surface 429 of arm 428 to push first contact surface 345 of lever 344 with sufficient force to overcome the bias force of spring 347 that is directed along direction 348 (see FIG. 11), so that the media stopper elements (not shown in FIG. 15) are retracted into the slots 349 of media retention plate 340. Note that the direction of arrows 351 for rotation of the pick roller 350 and reverse direction 317 for the feed roller 312 are the same. However, because the pick roller 350 is in contact with the top side of the piece of media, and feed roller 312 is in contact with the bottom side of the piece of media, when the piece of media arrives at feed roller 312, the reversely rotating feed roller 312 tends to push the leading edge of the piece of media backwards. In this way any skew of the leading edge is substantially eliminated.

Figure 16:
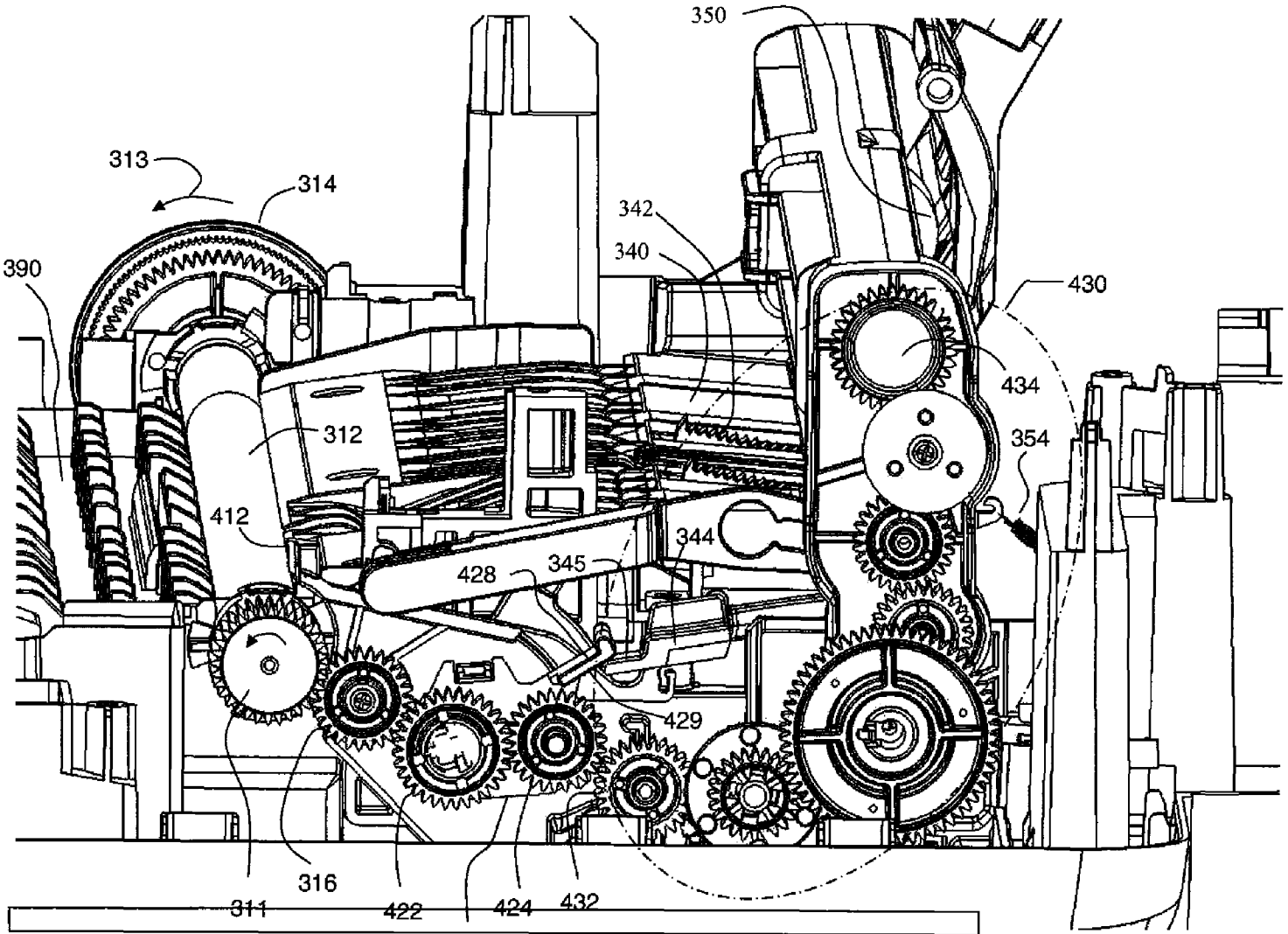
FIG. 16 is a close-up side perspective view with the pick arm assembly biased against the media input support and the pick clutch assembly rotating out of engagement with the gear train, allowing the media stopper to protrude, according to a preferred embodiment of the invention.

After the deskewing of the leading edge is completed, the media advance motor is driven in the forward direction to rotate drive gear 314, feed roller 312 and feed roller gear 311 in the forward direction 313. Forwardly rotating feed roller gear 311 causes idle gear 316 and first gear 422 of pick clutch assembly 420 to rotate such that second gear 424 of pick clutch assembly 420 is rotated out of engagement with engaging gear 432 of gear train 430, as shown in FIG. 16. As a result, no rotational power is transmitted through gear train 430, so no rotational power is provided to pick roller 350. In addition, second contact surface 429 of arm 428 of pick clutch assembly 420 no longer pushes on first contact surface 345 of lever 344, so that the biasing force of spring 347 in direction 348 (see FIG. 11) causes the media stopper elements 342 to again extend upwardly from media retention plate 340.

Figure 17:
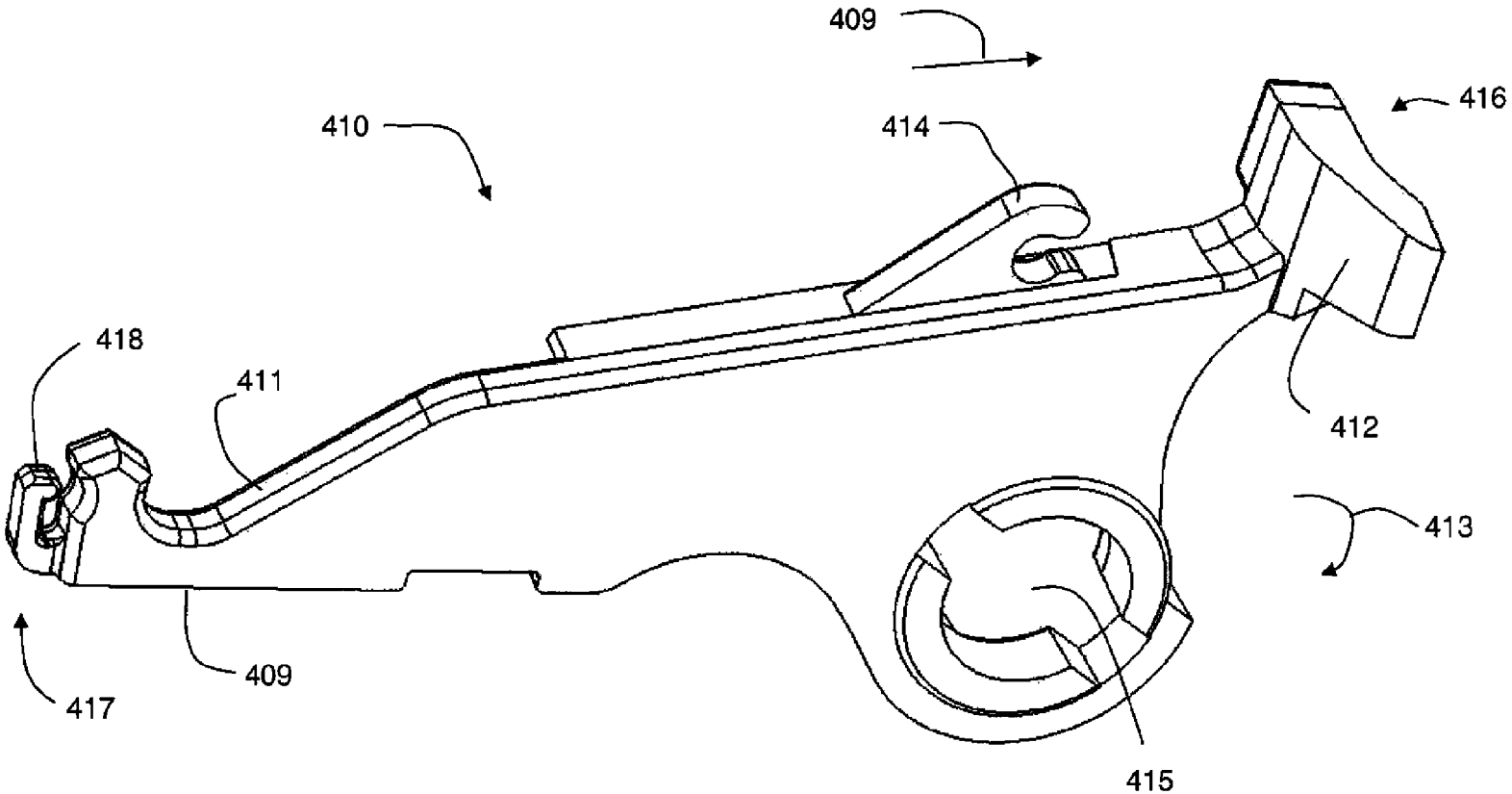
FIG. 17 is a perspective close-up view of a rotatable arm according to a preferred embodiment of the invention.
Figure 18:
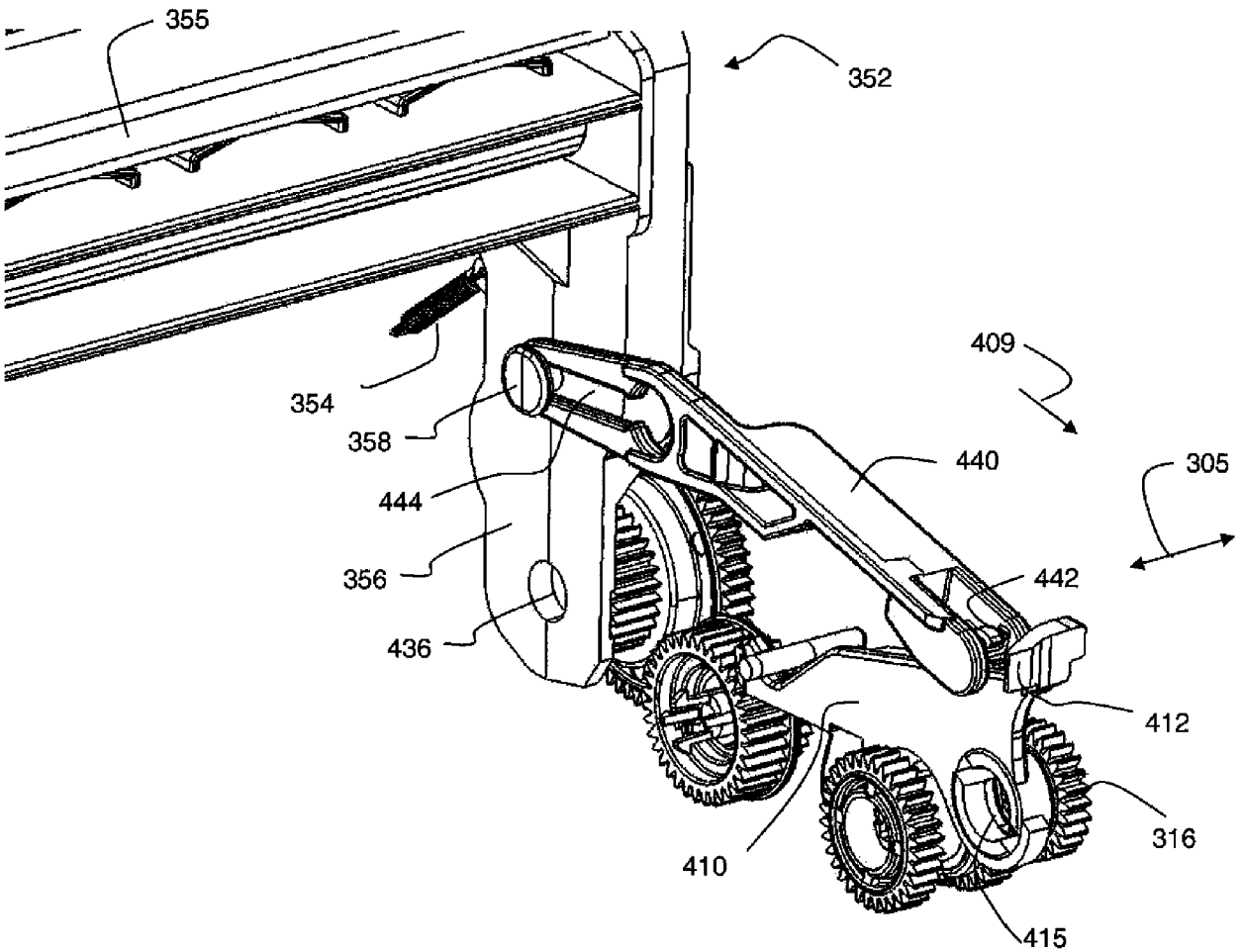
FIG. 18 is a perspective close up view of the rotatable arm, the pivotable pick arm assembly and a link arm that links them.

FIG. 17 is a perspective close-up view of rotatable arm 410 in isolation, as viewed approximately from the orientation of FIG. 12. When ramped feature 412 (located near first end 416) is engaged by sloped feature 210 on the underside of carriage 200 (see FIG. 8), rotatable arm 410 is rotated about hub 415 in rotation direction 413, causing linking hook member 414 to move substantially in direction 409. Linking hook member 414 attaches onto coupling pin 442 of link arm 440, as seen in FIG. 18, so that motion in direction 409 causes link arm 440 to pull on lug 358 on support leg 356, thereby causing support leg 356 of pivotable pick arm assembly 352 to pivot about pivot point 436. Coupling pin 442 is substantially parallel to carriage scan direction 305. Link arm 440 also includes a slot 444. When support leg 356 is being pivoted forward as in FIG. 18 (providing a gap between pick roller 350 and media input support 320 as in FIG. 11) the lug 358 is typically located at the end of the slot 444. A spring attachment member 418 located near second end 417 of rotatable arm 410 (opposite first end 416) is for attaching an extension spring 360 (see FIG. 18) to bias rotatable arm 410 against rotating in rotation direction 413. Thus, when the ramped feature 412 is engaged by sloped feature 210 on the underside of carriage, it needs to pull against both biasing springs 354 as well as extension spring 360.

Figure 19:
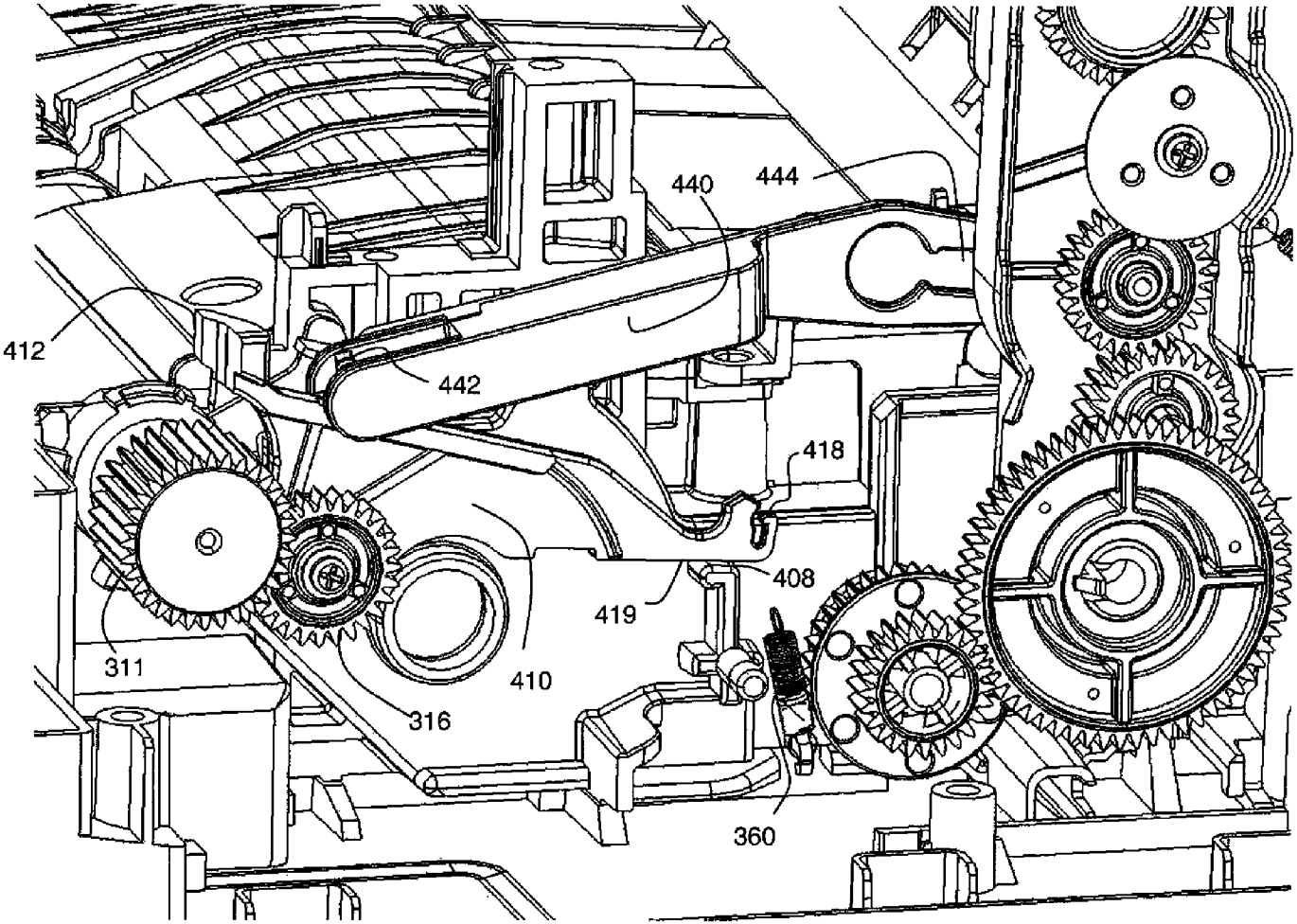
FIG. 19 is a close-up side perspective view of a portion of the views of FIGS. 14 and 15.

FIG. 19 is a close-up side perspective view of a portion of the views of FIGS. 14 and 15 with some features hidden in order to show other features. Extension spring 360 is shown as being detached from spring attachment member 418, but in a fully assembled printer it would be attached. Extension spring 360 is configured to pull rotatable arm 410 toward a predetermined position that is defined by bottom edge 419 being in contact with fixed stop 408. When sloped feature 210 of carriage 200 (see FIG. 8) is engaged with ramped feature 412 of rotatable arm 410, rotatable arm 410 is rotated away from this predetermined position.

Figure 20:
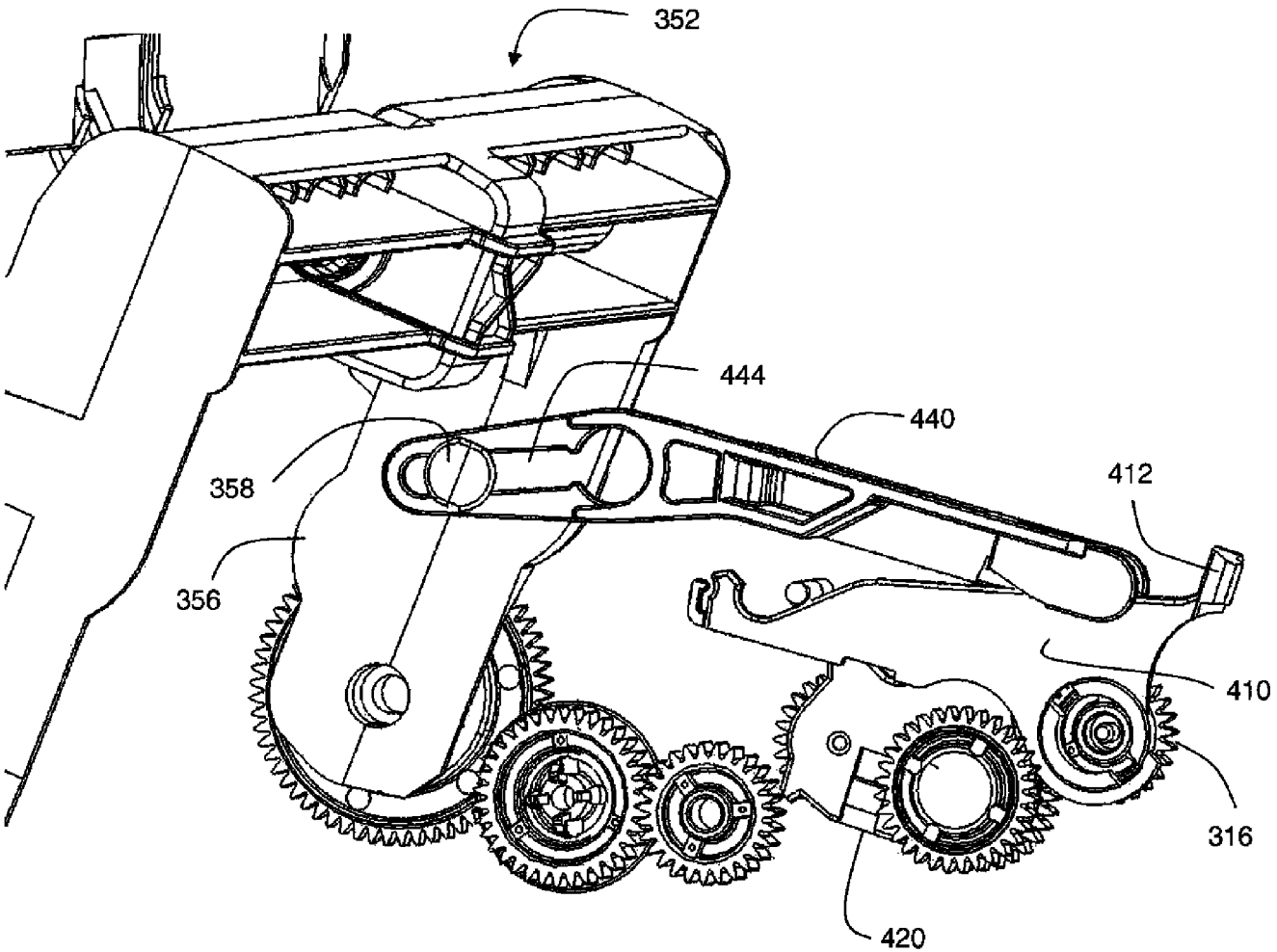
FIG. 20 is a side perspective view where the pick roller is moved farther away from the media input support than the gap provided when the ramp feature is engaged.

As described above relative to FIG. 10, when carriage 200 is in the home position and ramped feature 412 is engaged, pivotable pick arm assembly 352 is pivoted forward to provide a gap of 2 mm up to 6 mm or more between pick roller 350 and media input support 320. However, in many cases a user will want to load a stack of media that has a thickness of greater than the gap provided when the ramp feature 412 is engaged. Slot 444 of link arm 440 allows pivotable pick arm assembly 352 to pivot farther forward so that the pick roller 350 is moved away from media input support 320 by more than one centimeter without causing link arm 440 to push on rotatable arm 410. The side perspective view of FIG. 20 shows lug 358 of support leg 356 having moved along slot 444 in order to allow pick roller 350 to be moved farther away from media input support 320 than the gap provided when ramp feature 412 is engaged. FIGS. 18 and 20 also show that idle gear 316 is mounted at hub 415 of rotatable arm 410.

Figure 21:
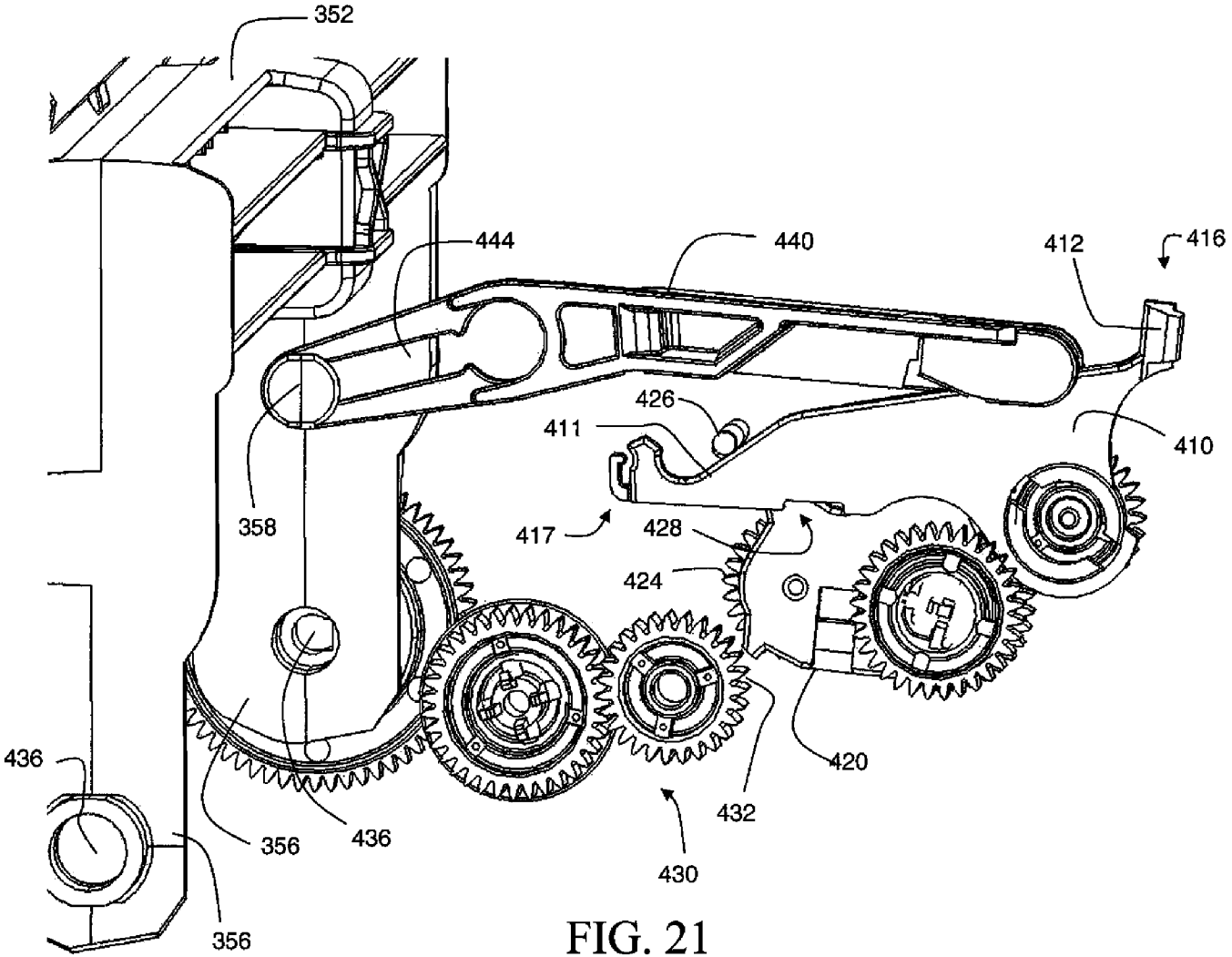
FIG. 21 is a close-up side perspective view of rotatable arm, pick clutch assembly, link arm and pivotable pick arm assembly.

FIG. 21 is a close-up side perspective view of rotatable arm 410, pick clutch assembly 420, link arm 440 and pivotable pick arm assembly 352 in a configuration such that ramped feature 412 is engaged with sloped feature 210 of carriage 200 (see FIG. 8), and lug 358 is at the rear of slot 444. In this configuration a top edge 411, which is hook-shaped and located near second end 417 of rotatable arm 410 in this example, pulls on finger 426 of pick clutch assembly 420 so that second gear 424 is pulled out of engagement with engaging gear 432 of gear train 430. As a result, pick roller 350 is not rotated whether the feed roller 312 is rotated in the forward direction 313 or the reverse direction 317 (see FIGS. 14 and 16). Although arm 428 is mostly obscured from view in FIG. 21, finger 426 extends from arm 428. Because rotatable arm 410 pulls finger 426 when the sloped feature 210 of carriage 200 is engaged with ramped feature 412, second contact surface 429 of arm 428 is prevented from bearing against first contact surface 345 of lever 344, so that force is not applied to first contact surface 345 of lever 344. In other words, when the carriage is in the home position, the media stopper elements 342 will always be biased to extend upwardly from media retention plate 340, no matter whether or in which direction the feed roller 312 is rotated.

Figure 22:
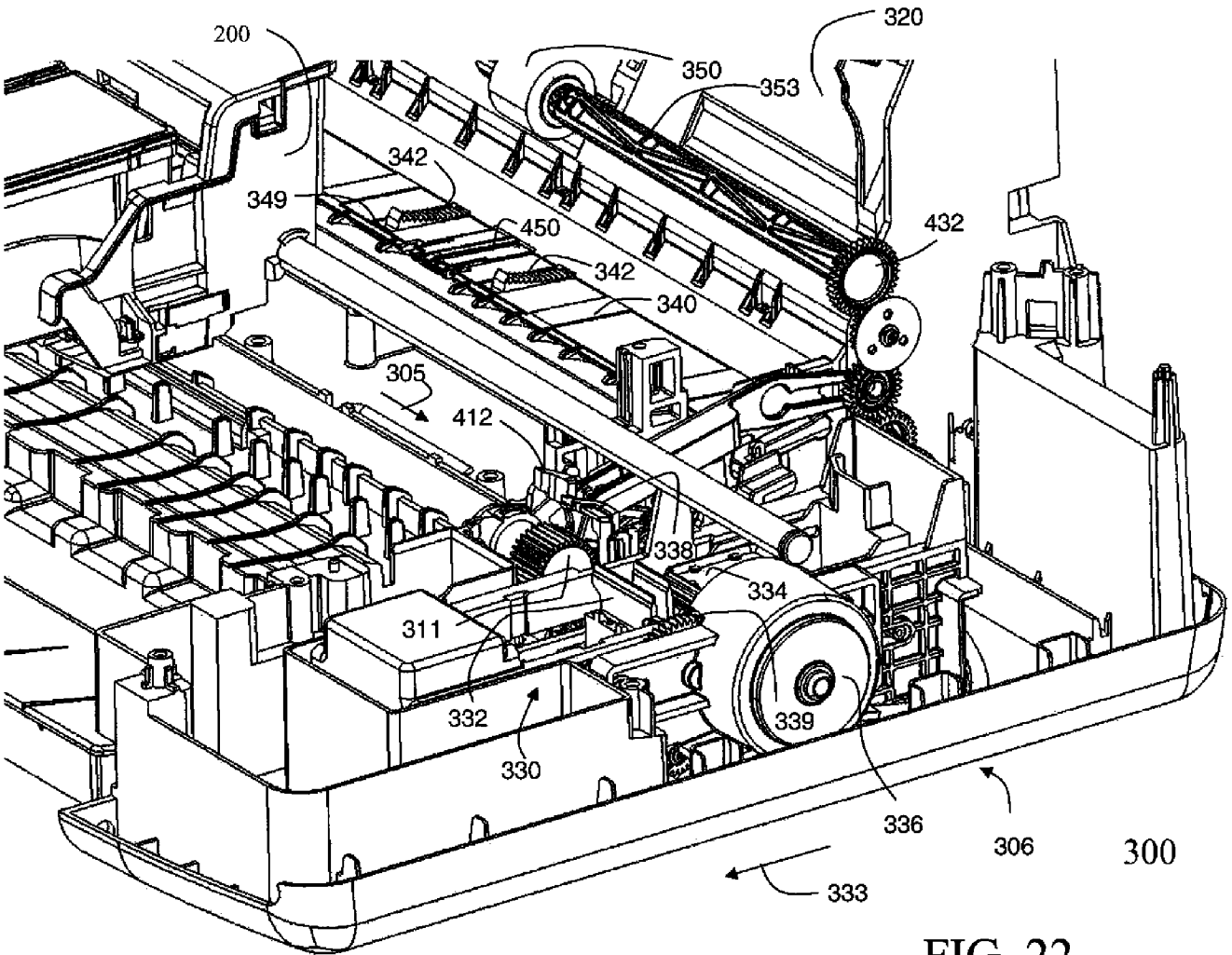
FIG. 22 is a side perspective view of a portion of an inkjet printing system including a maintenance station.

FIG. 22 is a perspective view of the right side 306 of printer chassis 300. Maintenance station 330 is similar to the maintenance station described in US Patent Application Publication 2009/0174748, which is incorporated by reference herein in its entirety. Activator arm 338 is analogous to the latching clutch arm of '748 and has a ramped surface similar to ramped feature 412. In particular, in the present invention when carriage 200 moves all the way to its home position at maintenance station 330, sloped feature 210 on the underside of carriage 200 (see FIG. 8), not only engages ramped feature 412, but also activator arm 338. When activator arm 338 is engaged, power from the media advance motor is transmitted from feed roller gear 311 to a set of maintenance station gears (only one of which 339 is shown). As described relative to FIG. 21, when ramped feature 412 is engaged with sloped feature 210, no power is transmitted to pick roller 350, so there is no additional load on the media advance motor when it is powering the maintenance station 330. In addition, the media stopper elements 342 will always extend upwardly from media retention plate 340 when ramped feature 412 is engaged, independent of motor rotation. When the activator arm 338 is engaged and the media advance motor is rotated in a reverse direction to rotate the feed roller gear 311 in a reverse direction 317 (see FIG. 15), the wiper 332 is moved along direction 333 to wipe the printhead that is positioned over the maintenance station 330. Further reverse rotation of feed roller gear 311 causes cap 334 to move into a printhead capping position to prepare the printer for a period of non-printing. Pump 336 can optionally be operated by further reverse rotation. When it is time to begin another print job, the media advance motor is rotated in a forward direction to rotate feed roller gear 311 in a forward direction 313 (see FIG. 16) and the cap 334 is moved out of the printhead capping position. Continued forward rotation of the media advance motor then causes wiper 332 to move in a direction that is opposite direction 333 in order to wipe the printhead. Pump 336 can optionally be operated by further forward rotation.

In FIG. 22 the housing of pick roller assembly 352 has been hidden in order to show pick roller drive shaft 353 and how it connects pick roller 350 with pick roller drive gear 432. Also, as seen in FIG. 21, both the ramped feature 412 of rotatable arm 410 and the activator arm 338 are located near maintenance station 330 so that they can both be engaged when the carriage 200 enters its home position at the maintenance station. Furthermore, in this embodiment, activator arm 338 is between rotatable arm 410 and maintenance station 330. Also indicated in FIG. 22 is media separator 450 located between two media stopper elements 342, i.e. near slots 349. Typically a media separator includes a high friction surface to prevent lower sheets from advancing as the upper sheet is moved out of the media input support 320.

Having described the features provided within the apparatus it is now possible to describe the method of feeding media in the inkjet printing system. Controller 14 (see FIG. 2) of the printer is programmed to operate the various functions of the printer, including the functions of the motor that moves the carriage, and the motor that advances the media. When it is desired to feed a sheet of media, feed roller 312 is rotated in reverse direction 317, thereby causing the pick clutch assembly 420 to pivot the second gear 424 into engagement with gear train 430. Arm 428 of pick clutch assembly 420 is also pivoted to bring the second contact surface of arm 428 to bear against the first contact surface 345 of lever 344 of the media stopper 341. As feed roller 312 continues to rotate in reverse direction 317, arm 420 is further rotated to push lever 344. Engagement of the second gear 424 with gear train 430 as pick roller 350 is rotated (in its rotation direction) provides sufficient torque that the biased stopper element 342 is retracted through slot 349 of the media retention plate 340. The rotating pick roller 350 thus advances a piece of media from the media input support 320 past the retracted stopper element 342 toward the feed roller 312. A lead edge of the piece of media can be detected in a position that is past the media retention plate 340 by a mechanical flag, an optical sensor, or other such sensor (not shown). A suitable amount of time is provided after detection of the lead edge for the lead edge of the piece of media to reach feed roller 312. Pick roller 350 continues to rotate as feed roller 312 continues to rotate in the reverse direction 317 in order to oppose the passage of the lead edge, thereby straightening out the paper if it is skewed. Then the controller 14 instructs the media advance motor to rotate in the forward direction. This moves the piece of paper toward the print region 303 so that an image can be printed on it. The motion in the forward direction 313 of the feed roller causes the pick clutch assembly 420 to disengage from gear train 430 (by pivoting second gear 424 out of engagement with gear train 430) so that rotational power is no longer provided to pick roller 350. Thus the pick roller 350 does not tend to move the next piece of paper out of media input support 320 until the controller 14 later instructs the media advance motor to rotate in reverse again, after the previous page is discharged from the printer. Changing the direction of rotation of the feed roller 312 to the forward direction 313 also causes arm 428 to rotate such that the second contact surface 429 of arm 428 is out of contact with the first contact surface of lever 344 of media stopper 341. This allows spring 347 to again bias the media stopper element 342 to protrude through slot 349 of the media retention plate 340. Thus, remaining sheets in the paper stack are prevented from advancing past the media retention plate 340.

When the carriage 200 moves into its home position after a printing job, not only does the engaged ramped feature 412 with the sloped feature of the carriage cause the pick arm assembly 352 to move away from media input support 320 and stop transmission of rotational power to the pick roller 350, in addition the pick clutch assembly 420 is pulled by rotatable arm 410 so that second contact surface 429 of arm 428 is prevented from bearing against first contact surface 345 of lever 344. As a result, when carriage 200 is in its home position, media stopper elements 342 are in their normal position, biased upward to protrude through the slots 349 of media retention plate 340.

Because the media stopper elements 342 are normally biased to protrude through the slots 349 of media retention plate 340, the user can load media at media input support 320 at almost any time and have the media stopper elements protruding so that sheets of media are prevented from inadvertently being loaded too far into the printing mechanism. The only time the media stopper elements 342 are retracted into the slots 349 is when a piece of media is being picked from the media input support 320, and it is unlikely that the user would attempt loading media during this brief time. Thus, a simple and low-cost apparatus and method for moving media stopper elements in a reliable fashion have been provided.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
202 Holder
204 Window
205 Bushing
210 Sloped feature
244 Connector
250 Printhead
251 Printhead die
253 Nozzle array
254 Nozzle array direction
255 Mounting support member
256 Encapsulant
257 Flex circuit
258 Connector board
262 Multi-chamber ink supply
264 Single-chamber ink supply
270 Ink drops
271 Ink port
272 Compartment
274 Compartment
300 Printer chassis
301 Paper load entry direction
302 Base
303 Print region
304 Media advance direction
305 Carriage scan direction
306 Right side of printer chassis
307 Left side of printer chassis
309 Rear of printer chassis
311 Feed roller gear
312 Feed roller
313 Forward rotation direction (of feed roller)
314 Drive gear
316 Idle gear

317 Reverse rotation direction (of feed roller)
318 Motor mount region
320 Media input support
321 First side
322 Second side
323 Idler roller
324 Discharge roller
325 Star wheel(s)
330 Maintenance station
332 Wiper
333 Direction
334 Cap
336 Pump
338 Activator arm (for maintenance station)
339 Maintenance station gear
340 Media retention plate
341 Media stopper
342 Media stopper element
343 Rotatable shaft
344 Lever
345 First contact surface
346 Spring attachment feature
347 Spring
348 Lever biasing direction
349 Slot
350 Pick roller
351 Rotation direction
352 Pick arm assembly
353 Pick roller drive shaft
354 Biasing spring
355 Support arm
356 Support leg
358 Lug
360 Extension spring
370 Stack of media
371 First piece of medium
382 Carriage guide rail
390 Platen
392 Absorbent material
394 Support ribs
408 Fixed stop
409 Direction
410 Rotatable arm
411 Top edge
412 Ramped feature
413 Rotation direction
414 Linking hook member
415 Hub
416 First end
417 Second end
418 Spring attachment member
419 Bottom edge
420 Pick clutch assembly
422 First gear (of pick clutch assembly)
424 Second gear (of pick clutch assembly)
426 Finger
428 Arm
429 Second contact surface
430 Gear train
432 Engaging gear (of gear train)
434 Pick roller drive gear
436 Pivot point
440 Link arm
442 Coupling pin
450 Media separator

The invention claimed is:

1. A method of feeding media in an inkjet printing system, the method comprising:

providing a media input support;

providing a media retention plate disposed at an angle with respect to the media input support, the media retention plate including a slot;

providing a media stopper including:

a rotatable shaft;

a stopper element extending from the rotatable shaft and biased to protrude through the slot of the media retention plate; and a lever extending from an end of the rotatable shaft, the lever including a first contact surface;

providing a pick roller configured to rotate in a rotation direction to move a piece of media from the media input support past the media retention plate;

providing a gear train for transmitting power to rotate the pick roller;

providing a feed roller configured to receive the piece of media from the pick roller, the feed roller including:

a forward direction of rotation to move the piece of media in a same direction as the rotation direction of the pick roller; and a reverse direction of rotation that is opposite the forward direction;

providing a feed roller gear that is coaxially mounted on the feed roller;

providing a pick clutch assembly including:

a first gear that is engaged with the feed roller gear;

a second gear; and an arm including a second contact surface;

rotating the feed roller in the reverse direction, thereby causing the pick clutch assembly to pivot the second gear into engagement with the gear train;

bringing the second contact surface of the arm of the pick clutch assembly to bear against the first contact surface of the lever of the media stopper;

rotating the arm of the pick clutch assembly to push the lever; and forcing the biased stopper element to retract through the slot of the media retention plate.

2. The method according to claim 1 further comprising rotating the pick roller in the pick roller rotation direction as the biased stopper element is retracted.

3. The method according to claim 1 further comprising:

changing the rotation direction of the feed roller to the forward direction;

rotating the arm of the pick clutch assembly so that the second contact surface of the arm is out of contact with the first contact surface of the lever of the media stopper; and allowing the biased stopper element to protrude through the slot in the media retention plate.

4. The method according to claim 3 further comprising pivoting the second gear of the pick clutch assembly out of engagement with the gear train.

5. The method according to claim 3 further comprising detecting a lead edge of a piece of media in a position that is past the media retention plate, wherein the step of changing the direction of the feed roller to the forward direction is done after the step of detecting the lead edge of the piece of media.

6. The method according to claim 5, wherein the step of changing the direction of the feed roller to the forward direction is done after the lead edge of the piece of media has reached the feed roller.

7. The method according to claim 1 further comprising loading media into the media input support when the media stopper is protruding through the media retention plate.

8. The method according to claim 1 further comprising:

providing a rotatable arm including a ramped feature;

providing a carriage that is movable along a carriage scan direction, the carriage including a sloped feature that is in line with the ramped feature of the rotatable arm;

engaging the sloped feature of the carriage with the ramped feature of the rotatable arm; and pulling the pick clutch assembly with the rotatable arm, thereby preventing the second contact surface of the arm of the pick clutch assembly from bearing against the first contact surface of the lever.

9. The method according to claim 1 further comprising:

providing a carriage that is movable along a carriage scan direction, the carriage including a holder for an inkjet printhead;

providing a home position for the carriage; and moving the carriage into the home position, thereby preventing the second contact surface of the arm of the pick clutch assembly from bearing against the first contact surface of the lever.

* * * * *